US006905110B2

(12) United States Patent
Brown

(10) Patent No.: US 6,905,110 B2
(45) Date of Patent: Jun. 14, 2005

(54) FINISHED-STAIR-TREAD ADAPTER FOR A MODULAR RAILING SYSTEM

(76) Inventor: Alexander Brown, 1495 S. Vinta Ct., Denver, CO (US) 80231

( * ) Notice: Subject to any disclaimer, the term of this patent is extended or adjusted under 35 U.S.C. 154(b) by 0 days.

(21) Appl. No.: 10/299,490

(22) Filed: Nov. 18, 2002

(65) Prior Publication Data

US 2003/0122117 A1 Jul. 3, 2003

Related U.S. Application Data

(62) Division of application No. 09/712,648, filed on Nov. 13, 2000, now Pat. No. 6,481,697.
(60) Provisional application No. 60/164,702, filed on Nov. 10, 1999.

(51) Int. Cl.[7] ..... E04H 17/14
(52) U.S. Cl. ..... 256/67; 256/65.14; 256/59; 256/60; 256/DIG. 6; 403/387; 248/519; 248/534; 248/536; 52/182
(58) Field of Search ..... 256/67, 65.14, 256/59, 60, DIG. 2, DIG. 6; 403/387; 248/536, 534, 519, 511; 52/182

(56) References Cited

U.S. PATENT DOCUMENTS

| | | | | | |
|---|---|---|---|---|---|
| 373,729 | A | | 11/1887 | Eske | 256/21 X |
| 1,316,155 | A | * | 9/1919 | Harrison et al. | 256/65.05 |
| 2,129,999 | A | | 9/1938 | Ewing | 256/21 X |
| 2,380,379 | A | * | 7/1945 | Attwood | 248/228.1 |
| 2,435,171 | A | | 1/1948 | Weisz | 52/637 |
| 2,559,469 | A | | 7/1951 | Scheidemantle | 403/326 |
| 2,696,139 | A | * | 12/1954 | Attwood | 411/959 |
| 2,830,856 | A | | 4/1958 | Scheidemantle | 52/646 |
| 2,842,408 | A | | 7/1958 | Symons | 52/645 |
| 2,855,184 | A | | 10/1958 | Moore | 256/21 |
| 2,882,099 | A | | 4/1959 | Symons | 52/645 |
| 2,991,854 | A | | 7/1961 | Dubois et al. | 52/646 X |
| 2,994,402 | A | | 8/1961 | Tyler | 182/152 |
| 3,095,070 | A | | 6/1963 | McDonald | 52/638 X |
| 3,776,523 | A | | 12/1973 | Weiland | 256/65 X |
| 3,835,612 | A | | 9/1974 | Beziat | 52/638 |
| 3,885,648 | A | | 5/1975 | Beziat | 52/638 |
| 4,408,928 | A | * | 10/1983 | Steinke | 403/387 |
| 5,156,235 | A | | 10/1992 | Preston | 248/235 |
| 5,431,372 | A | | 7/1995 | Kostelecky | 256/64 |
| D366,531 | S | | 1/1996 | Wedge | D25/66 |
| 5,617,689 | A | * | 4/1997 | Beane | 52/489.1 |
| 6,142,453 | A | | 11/2000 | Martin | 256/65 |
| 6,279,880 | B1 | * | 8/2001 | Hawks, Jr. | 256/65.14 |

OTHER PUBLICATIONS 4 photograph copies, c. 1950, of a bracing system scaffold. Applicant believes possibly manufactured by Safeway Scaffold Company.

* cited by examiner

*Primary Examiner*—John R. Cottingham
*Assistant Examiner*—Ernesto Garcia
(74) *Attorney, Agent, or Firm*—Heimbecher & Assoc., LLC

(57) ABSTRACT

A modular railing system supports a plurality of rails in vertically-spaced configuration. The railing system includes a plurality of baluster units arranged between rail sets to support the rails. The baluster units include a plurality of rail supports grouped into double barrel support pairs or single barrel support pairs. The baluster units may include a short section of kick rail, and longer sections of kick rail may extend between adjacent baluster units. Also, additional rails may be joined to the modular railing system using baluster extensions or extender bars. A stair rail adjuster may be used, particularly when railing staircases, to permit adjustment of the relative vertical height of one end of a rail. To attach rails and balusters to stair treads, a finished-stair-tread adapter may be used. The finished-stair-tread adapter includes a baluster mounting member, a tread plate having a first plurality of slip nuts slidingly mounted therein, and a riser plate having a second plurality of slip nuts slidingly mounted therein.

16 Claims, 25 Drawing Sheets

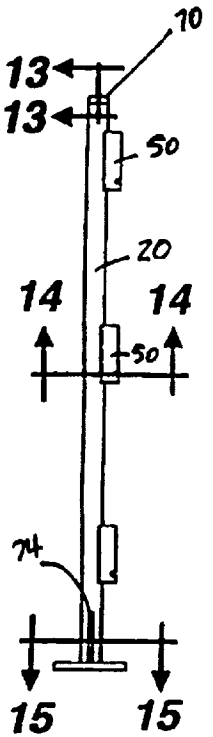
Fig. 12
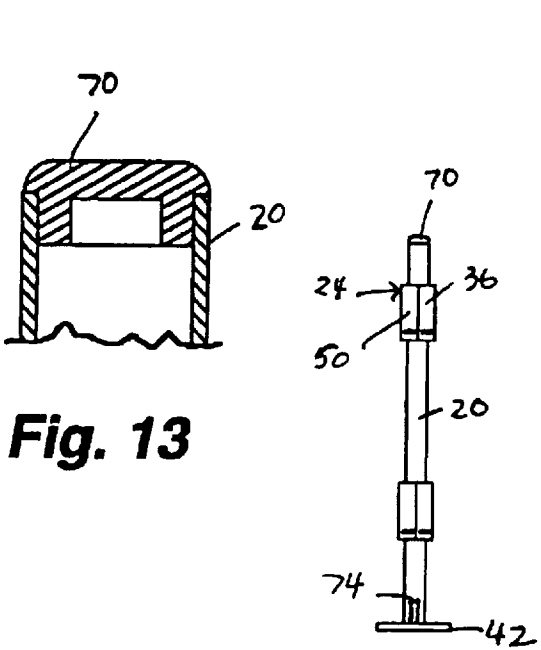
Fig. 16
Fig. 11
Fig. 13
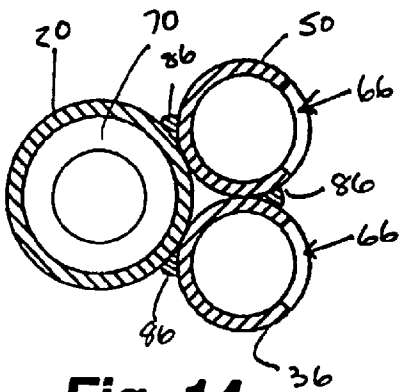
Fig. 14
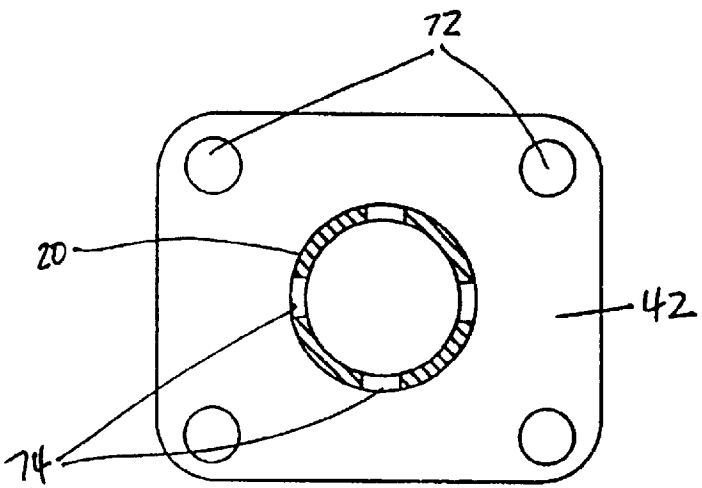
Fig. 15

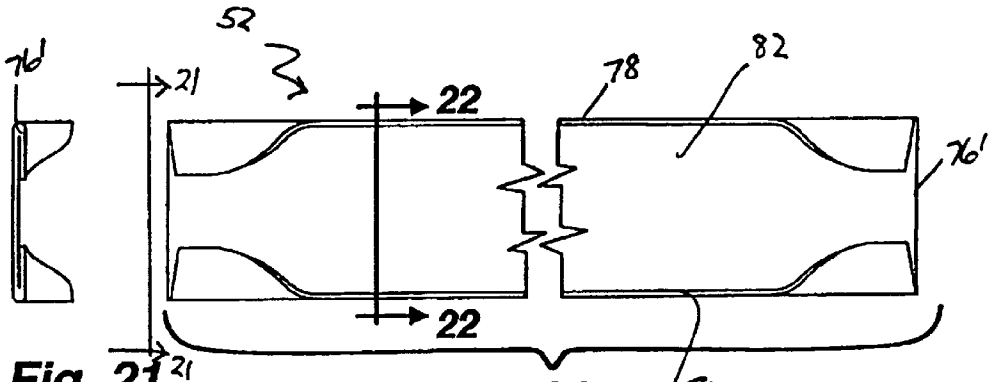
Fig. 20
Fig. 21
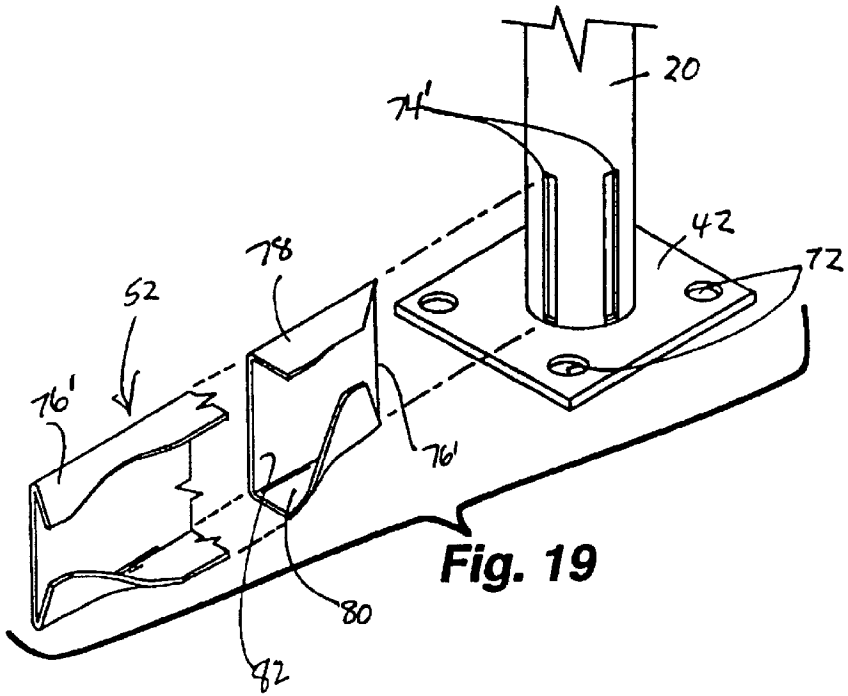
Fig. 19
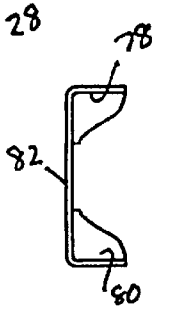
Fig. 22
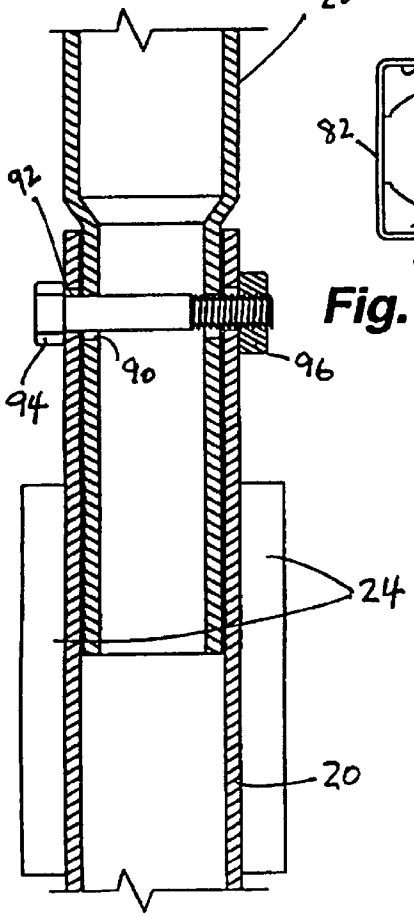
Fig. 18

FINISHED-STAIR-TREAD ADAPTER FOR A MODULAR RAILING SYSTEM

CROSS-REFERENCE TO RELATED APPLICATION

This application is a division of United States utility patent application Ser. No. 09/712,648, filed 13 Nov. 2000 (the '648 application), now U.S. Pat. No. 6,481,697, issued 19 Nov. 2002, which in turn claims priority to U.S. provisional application No. 60/164,702, filed 10 Nov. 1999 (the '702 application). The '648 and '702 applications, and the '697 patent, are hereby incorporated by reference as though fully set forth herein.

BACKGROUND OF THE INVENTION a. Field of the Invention

The present invention is generally directed toward safety equipment for use at construction sites. More specifically, it relates to a modular railing system to enhance safety at construction sites.

b. Background Art

It is well known by those in the construction industry that, while construction is taking place at commercial and residential building sites, certain safety measures must be taken to protect the workers moving around the building site. In particular, until the structure itself is framed, when uncontained horizontal surfaces are present, there is a need to protect those persons working near the edges of the floors and on staircases.

Further, the regulations of the Occupational, Safety and Health Administration (OSHA) of the United States government require the placement of safety railings along the edges of floors and staircases. To satisfy OSHA regulations, these safety railings must be able to resist certain minimum lateral loads without becoming permanently deformed or destroyed. For example, it is a requirement under certain circumstances that the safety railing be able to support a load of 200 lbs. in any outward or downward direction, without component failure. Similarly, kick rails or toe boards must, under certain circumstances, be able to support a load of 50 lbs. in any outward or downward direction.

Although other safety railing systems have been constructed and used in the past, there remains a need for a modular railing system that provides adequate safety to construction workers, including construction workers using stilts.

BRIEF SUMMARY OF THE INVENTION

It is desirable to be able to construct a railing system that is modular and relatively easily tailored to meet a variety of physical circumstances present at job sites.

Accordingly, it is an object of the disclosed invention to provide an improved modular railing system for construction sites.

In a first preferred form, the modular railing system is used for railing a substantially-horizontal surface. In this form, the invention comprises a plurality of rails, the rails being grouped into rail sets, each of the rail sets comprising at least one rail, and each rail having an elongated portion extending between two connector portions. A plurality of baluster units support the plurality of rails, and each baluster unit comprises a plurality of rail supports spaced vertically along the baluster unit and affixed thereto. The baluster units according to the first preferred form comprise a baluster pair including a first baluster and a second baluster, the first and second balusters being anchored to the substantially-horizontal surface in close proximity to each other; a plurality of double barrel supports spaced along and affixed to the first baluster, each of the double barrel supports that is affixed to the first baluster having a corresponding double barrel support spaced along and affixed to the second baluster, wherein each of the double barrel supports on the first baluster together with its corresponding double barrel support on the second baluster collectively comprise a double barrel support pair; and a plurality of tie pipes, each tie pipe connecting the double barrel supports of one double barrel support pair.

Each baluster unit according to a first alternative form comprises an inverted-U-shaped main baluster tube having first and second legs, each leg having a lower distal end that has a plurality of retention slots formed therein, the distal ends of the legs being affixed to an elongated base plate that includes an integrated short kick rail having lateral ends that are accommodated by two of the plurality of retention slots, wherein the base plate is anchored to the substantially-horizontal surface; and a plurality of single barrel supports spaced along and affixed to the first leg, each of the single barrel supports that is affixed to the first leg having a corresponding single barrel supports spaced along and affixed to the second leg, wherein each of the single barrel supports on the first leg together with its corresponding single barrel support on the second leg collectively comprise a single barrel support pair.

Each baluster unit according to a second alternative form comprises a first vertical baluster tube and a second vertical baluster tube, each of the first and second balusters tubes having a lower distal end, each of the lower distal ends having a plurality of retention slots formed therein, and each of the lower distal ends being affixed to a shared base plate that is anchored to the substantially-horizontal surface; at least one elongated web rigidly connected between the first and second baluster tubes, wherein each elongated web has two longitudinal edges and two lateral edges, wherein a first of the longitudinal edges is connected to the first baluster tube, and a second of the longitudinal edges is connected to the second baluster, and further wherein one of the lateral edges is affixed to the base plate; and a plurality of single barrel supports spaced along and affixed to the first baluster tube, each of the single barrel supports that is affixed to the first baluster tube having a corresponding single barrel support spaced along and affixed to the second baluster tube, wherein each of the single barrel supports on the first baluster tube together with its corresponding single barrel support on the second baluster tube collectively comprise a single barrel support pair.

Each baluster unit according to another alternative form comprises an elongated web having first and second longitudinal edges and two lateral edges, wherein one of the lateral edges is affixed to a base plate that is anchored to the substantially-horizontal surface, and wherein at least one retention slot exists through the elongated web adjacent to the lateral edge that is affixed to the base plate; and a plurality of single barrel supports spaced along and affixed to the first longitudinal edge, each of the single barrel supports that is affixed to the first longitudinal edge having a corresponding single barrel support spaced along and affixed to the second longitudinal edge, wherein each of the single barrel supports on the first longitudinal edge together with its corresponding single barrel support on the second longitudinal edge collectively comprise a single barrel support pair.

Each baluster unit according to yet another alternative form comprises at least two elongated webs, each having first and second longitudinal edges and two lateral edges, wherein one of the lateral edges of each elongated web is affixed to a base plate that is anchored to the substantially-horizontal surface, and wherein at least one retention slot exists through the elongated webs adjacent to the lateral edges affixed to the base plate; first and second narrow web strips, wherein the first narrow web strip is perpendicularly affixed to the first longitudinal edges of the elongated webs, and the second narrow web strip is perpendicularly affixed to the second longitudinal edges of the elongated webs; and a plurality of single barrel supports spaced along and affixed to the first narrow web strip, each of the single barrel supports that is affixed to the first narrow web strip having a corresponding single barrel support spaced along and affixed to the second narrow web strip, wherein each of the single barrel supports on the first narrow web strip together with its corresponding single barrel support on the second narrow web strip collectively comprise a single barrel support pair.

Each baluster unit according to another alternative form comprises a first vertical baluster tube and a second vertical baluster tube, each of the first and second balusters tubes having an upper distal end and a lower distal end, each of the lower distal ends having a plurality of retention slots formed therein, and each of the lower distal ends being affixed to a shared base plate that is anchored to the substantially-horizontal surface; first and second web sections, the first web section being rigidly connected between the first and second baluster tubes adjacent to the lower distal ends of the baluster tubes, and the second web section being rigidly connected between the first and second baluster tubes adjacent to the upper distal ends of the baluster tubes, wherein each of the first and second web sections has first and second lateral edges and two longitudinal edges, wherein the first lateral edges are connected to the first baluster tube, and the second lateral edges are connected to the second baluster tube, and further wherein one of the longitudinal edges of the first web section is affixed to the base plate; and a plurality of single barrel supports spaced along and affixed to the first baluster tube, each of the single barrel supports that is affixed to the first baluster tube having a corresponding single barrel support spaced along and affixed to the second baluster tube, wherein each of the single barrel supports on the first baluster tube together with its corresponding single barrel support on the second baluster tube collectively comprise a single barrel support pair.

Each baluster unit according to still another alternative form comprises a first vertical baluster tube and a second vertical baluster tube, each of the first and second balusters tubes having an upper distal end and a lower distal end, each of the lower distal ends having a plurality of retention slots formed therein, and each of the lower distal ends being affixed to a shared base plate that is anchored to the substantially-horizontal surface; a first web section rigidly connected between the first and second baluster tubes adjacent to the lower distal ends of the baluster tubes, wherein the first web section has first and second lateral edges and two longitudinal edges, wherein the first lateral edge is connected to the first baluster tube, and the second lateral edge is connected to the second baluster tube, and further wherein one of the longitudinal edges of the first web section is affixed to the base plate; an X-shaped structural support member rigidly connected between the first and second baluster tubes adjacent to both the lower and upper distal ends of the baluster tubes; and a plurality of single barrel supports spaced along and affixed to the first baluster tube, each of the single barrel supports that is affixed to the first baluster tube having a corresponding single barrel support spaced along and affixed to the second baluster tube, wherein each of the single barrel supports on the first baluster tube together with its corresponding single barrel support on the second baluster tube collectively comprise a single barrel support pair.

In another preferred form, the present invention comprises a device for adding an additional rail to a top of an existing modular railing system. In this preferred form, the device comprises a plurality of baluster extensions, each of the extensions having an upper end and a lower end, wherein each of the lower ends is tapered to fit into an upper end of a corresponding baluster, and further wherein a substantially horizontal hole extends through the tapered lower ends of the extension, and corresponding holes extend through upper ends of the balusters, wherein the holes align to receive a fastener when the baluster extensions are in place in the upper ends of the balusters.

In an alternative form of the device for adding an additional rail to the top of an existing modular railing system, the device comprises an extender bar. The extender bar comprises a main bar that is bent into a configuration having two downwardly-extending legs, each of the legs having an upper end and a lower end, wherein a single barrel support is affixed to each leg adjacent to its upper end, and wherein each of the lower ends of the legs is tapered to fit into an upper end of a corresponding baluster, and further wherein a substantially horizontal hole extends through the tapered lower ends of the extender bar legs, and corresponding holes extend through upper ends of the balusters, wherein the holes align to receive a fastener when the extender bar is in place in the upper ends of the balusters.

In another preferred form, the invention comprises a modular railing system for railing a staircase. In this form, the invention includes a plurality of staircase rails, the staircase rails being grouped into rail sets, each of the rail sets comprising at least one rail, each staircase rail having an elongated portion extending between a first connector portion and a second connector portion, wherein the first connector portion forms a first relative angle with the elongated portion, and wherein the second connector portion forms a second relative angle with the elongated portion, the second relative angle being different from the first relative angle; and a plurality of baluster units for supporting the plurality of staircase rails. The railing system for railing a staircase may also include a stair rail adjuster, the stair rail adjuster comprising a rail support having an internal cross-sectional configuration; and a longer cylindrical piece affixed to the rail support and having an external cross-sectional configuration designed to be slippingly accommodated by the internal cross-sectional configuration of the rail support.

In still another preferred form, the modular railing system of the present invention comprises a plurality of staircase rails; a plurality of balusters for supporting the plurality of staircase rails; and a finished-stair-tread adapter. The finished-stair-tread adapter comprises a baluster mounting member; a tread plate having a first plurality of slip nuts slidingly mounted therein, each slip nut of the first plurality of slip nuts having a fastener hole through it; and a riser plate having a second plurality of slip nuts slidingly mounted therein, each slip nut of the second plurality of slip nuts having a fastener hole through it.

In another preferred form, the present invention comprises a clamp-on railing system for railing a staircase having stringers or a pan staircase. This clamp-on railing system comprises a plurality of staircase rails, the staircase rails being grouped into rail sets, each of the rail sets comprising at least one rail, each staircase rail having an elongated portion extending between a first connector portion and a second connector portion, wherein the first connector portion forms a first relative angle with the elongated portion, and wherein the second connector portion forms a second relative angle with the elongated portion, the second relative angle being different from the first relative angle; and a plurality of baluster and mounting bracket combinations for supporting the plurality of staircase rails. Each of the mounting brackets comprises a C-shaped channel in which a plurality of large slip nuts are slippingly mounted, and each of the balusters has at least one mounting holes drilled though its lower end. At least one fastener is inserted through one of the mounting holes and fastened in a fastener hole through a center of a first one of the plurality of large slip nuts. The preferred form of the clamp-on system further comprises two L bolts, each L bolt being threaded into a large slip nut from the plurality of large slip nuts and threaded against an inner surface of the C-shaped mounting brackets to seat the corresponding slip nut firmly against inwardly-turned longitudinal edges of the C-shaped mounting bracket.

Other aspects, features, and details of the present invention will be apparent from reading the following description and claims, and from reviewing the accompanying drawings.

BRIEF DESCRIPTION OF THE DRAWINGS

FIG. 11 depicts a single baluster standing alone from a first perspective;

FIG. 12 depicts the baluster of FIG. 11 from a view that is offset 90° about the longitudinal axis of the baluster as shown in FIG. 11;

FIG. 13 is a fragmentary cross-sectional view along line 13—13 of FIG. 11, depicting the removable end cap in an upper portion of a baluster;

FIG. 14 is a cross-sectional view along line 14—14 of FIG. 11, depicting attachment of the double barrel support to a baluster and showing the rivet slots comprising part of each support;

FIG. 15 is a cross-sectional view along line 15—15 of FIG. 11, clearly depicting the relative position of the four retention slots of the preferred embodiment;

FIG. 16 is similar to FIG. 12, but depicts an alternative embodiment of a baluster designed to support only two rails;

FIG. 17A depicts an enlarged view of an extender bar, which provides an alternative way to that shown in FIG. 17 for adding an additional rail;

FIG. 18 is an enlarged fragmentary cross-sectional view along line 18—18 of FIG. 17;

FIG. 19 is a view similar to FIG. 5 but depicts the lower end of a baluster and one end of a second embodiment of a kick rail;

FIG. 20 is a fragmentary elevation of the second embodiment of the kick rail;

FIG. 21 is a fragmentary end view of the kick rail of FIG. 20 taken along line 21—21 of that figure;

FIG. 22 is a fragmentary cross-sectional view of the kick rail of FIG. 20 taken along line 22—22 of that figure;

DESCRIPTION OF THE PREFERRED EMBODIMENTS

The present invention comprises a modular railing system 10 that may be custom tailored to a variety of construction sites with a minimum of alteration. The modular railing system 10 depicted in, for example, FIG. 1 may be rapidly assembled at the construction site and rapidly disassembled when it is no longer needed. The resulting temporary railing system is smooth, with nothing that can readily catch on a worker's equipment or clothing.

Figure 1:
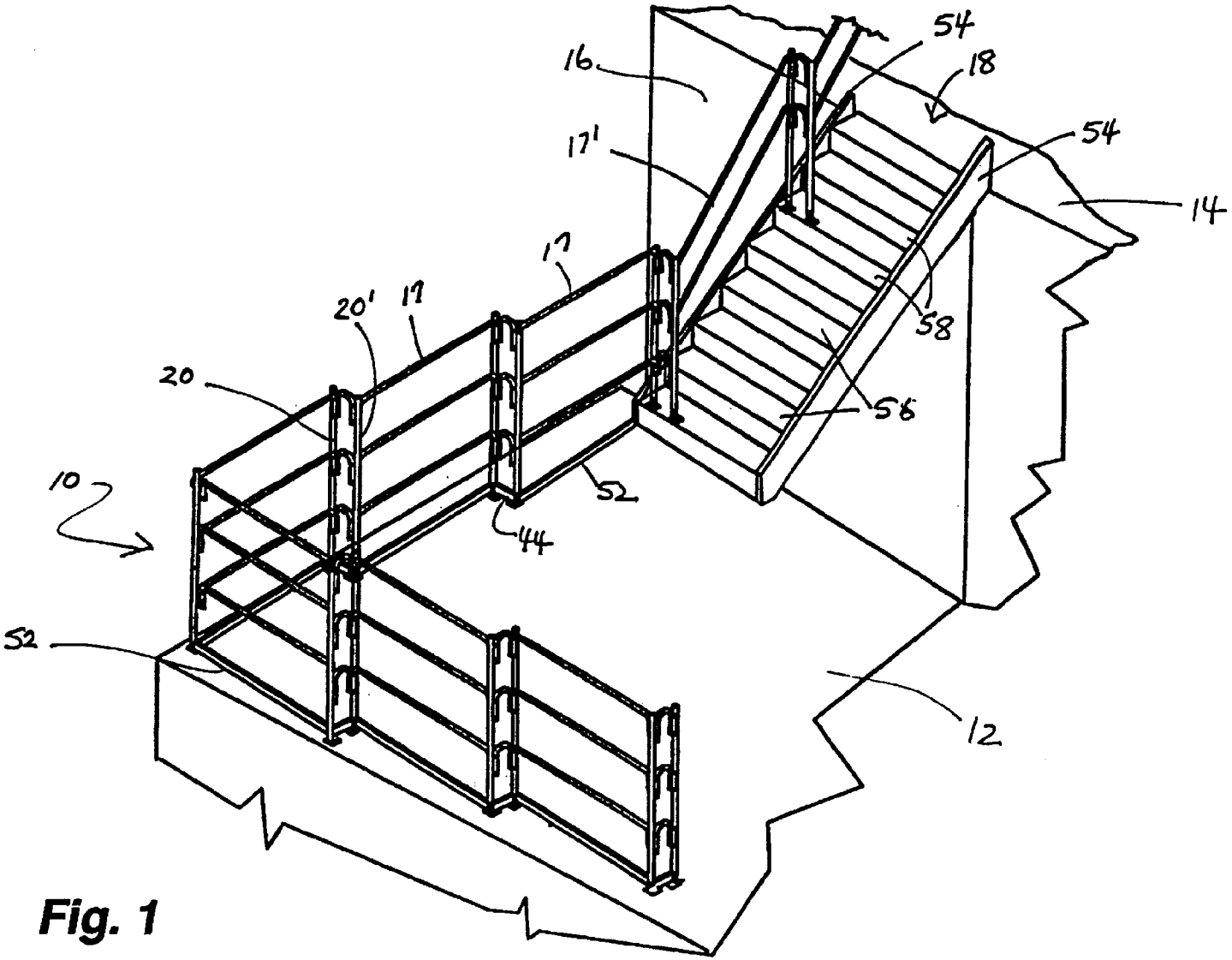
FIG. 1 is an isometric fragmentary view depicting different sections of the modular railing system of the present invention in place at a multi-leveled construction site where a lower substantially horizontal surface and an upper substantially horizontal surface are connected by a staircase.

Referring first to FIG. 1, a schematic representation of a construction site is shown with a first preferred embodiment of the modular railing system 10 of the present invention in position. As depicted, the construction site comprises a lower substantially horizontal surface 12 (or lower walking working surface) and an upper substantially horizontal surface 14 (or upper walking working surface) connected by a vertical wall 16, with a staircase 18 providing access between the lower surface 12 and the upper surface 14. As shown to best advantage in FIG. 1, the first preferred embodiment of the modular railing system 10 comprises two major types of sections. The first type of section is connected together on a horizontal surface like the depicted lower horizontal surface 12. The second type of section is used on sloping surfaces like the staircase 18 depicted in FIG. 1.

Figure 2:
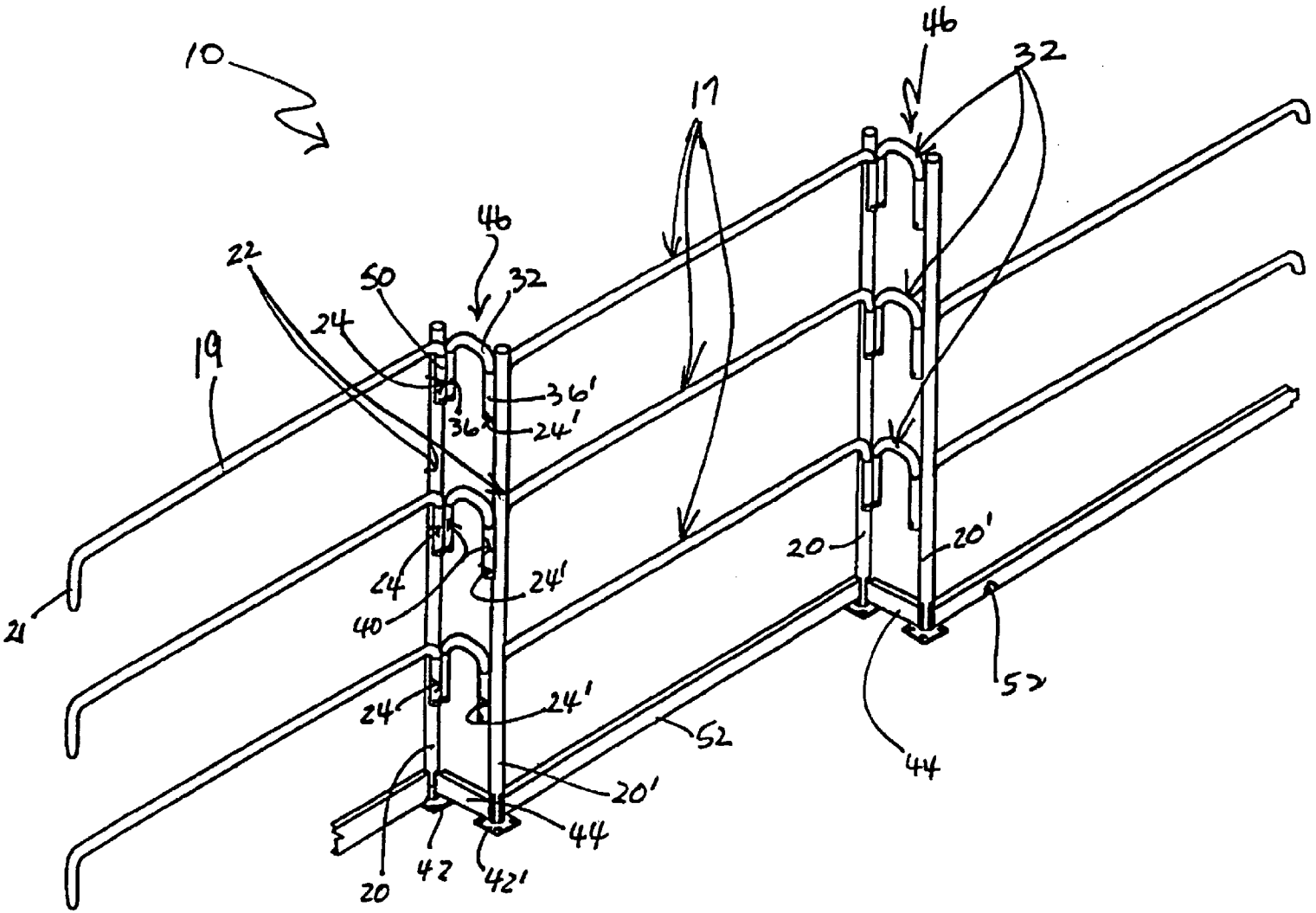
FIG. 2 is an enlarged isometric view of a portion of the section of the modular railing system depicted in FIG. 1 that is mounted on the lower substantially horizontal surface.

Referring more particularly to FIG. 2, which depicts a section of modular railing used on horizontal surfaces, various details of a first preferred embodiment of the present invention are described. The section depicted in FIG. 2 is three rails high, the three rails 17 being supported in vertically-spaced relation to one another, and each modular rail 17 has a substantially-horizontal elongated portion 19 between two substantially-vertical connector portions 21. In the first preferred embodiment for supporting the rails 17, two standards or balusters 20, 20', which are identical in the preferred embodiment, are attached to a substantially horizontal surface (e.g., the lower horizontal surface 12 depicted in FIG. 1) in close proximity to each other, thereby forming a baluster pair 22. In the first preferred embodiment of the three-rail system depicted in, for example, FIGS. 1 and 2, the balusters 20, 20' of a baluster pair 22 are substantially parallel and spaced apart approximately six to nine inches.

As will be described in more detail below, in the first preferred embodiment, each baluster 20, 20' includes a plurality of double barrel supports 24, 24'. In particular, as depicted in the section of modular railing shown in FIG. 2, three double barrel supports 24, 24' are welded to each baluster 20, 20'. If necessary, however, (e.g., if workers are using thirty-two or forty-two inch stilts) a fourth rail 26 (FIG. 17) may be added to the modular railing system 10 depicted in FIG. 2 using, for example, the baluster extensions 28, 28' depicted in FIGS. 17 and 18, or the extender bar 30 depicted in FIG. 17A, both of which are described further below. As shown in FIG. 2, a plurality of tie pipes 32 are used to connect the balusters 20, 20' of a baluster pair 22. With the balusters 20, 20' of a baluster pair 22 placed six inches apart, the tie pipes 32 have the inverted U-shaped appearance depicted. If, however, it were desirable to space the balusters 20, 20' of a baluster pair 22 a different distance apart, obviously the shape of the tie pipe 32 would vary accordingly. Each tie pipe 32 has two legs. One leg 34 (see FIG. 17) of a tie pipe 32 is inserted into one support 36 of a double barrel support 24 on one baluster 20 of a baluster pair 22. The opposite leg 38 (FIG. 17) of that same tie pipe 32 is inserted into one support 36' of a corresponding double barrel support 24' on the adjacent baluster 20' of the baluster pair 22. The two double barrel supports 24, 24' that are thus connected by a single tie pipe 32 comprise a double barrel support pair 40. The three-rail arrangement depicted in FIG. 2, wherein the balusters 20, 20' of each baluster pair 22 are placed approximately six inches apart, has been found to produce a modular railing system that is able to support the lateral load limits required by OSHA regulations.

As also shown in FIG. 2 and as explained further below in connection with FIG. 5, a base plate 42, 42' is fixed (e.g., by welding) to the lower end of each baluster 20, 20'. A short section of kick rail (or toe board) 44 is placed between the lower ends of the balusters 20, 20' of the baluster pair 22 just above the base plates 42, 42'. The two vertical balusters 20, 20' of a baluster pair 22, each with its own base plate 42, 42', a plurality of double barrel support pairs 40 (e.g., three in FIG. 2), a corresponding plurality of tie pipes 32, and a short section of kick rail 44, together comprise a "baluster unit" 46 according to a first preferred embodiment. Thus, the assembly between rail sets or at the end of a rail set is referred to herein as a "baluster unit" 46. FIGS. 23–34, which are described more fully below, depict alternative embodiments of baluster units. The baluster units 46 according to the first preferred embodiment just described in connection with primarily FIG. 2 use double barrel support pairs 40, while the alternative baluster unit embodiments described below in connection with FIGS. 23–34 use single barrel support pairs 48 (FIG. 24) for reasons discussed more fully below.

Figure 6:
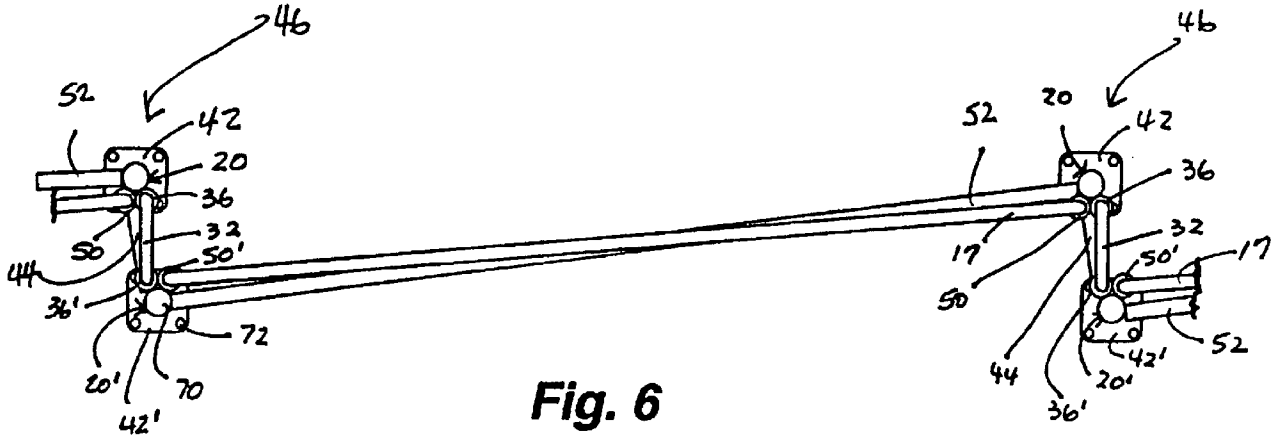
FIG. 6 is a top plan view of a portion of the section of the modular railing system depicted in FIG. 2.
Figure 7:
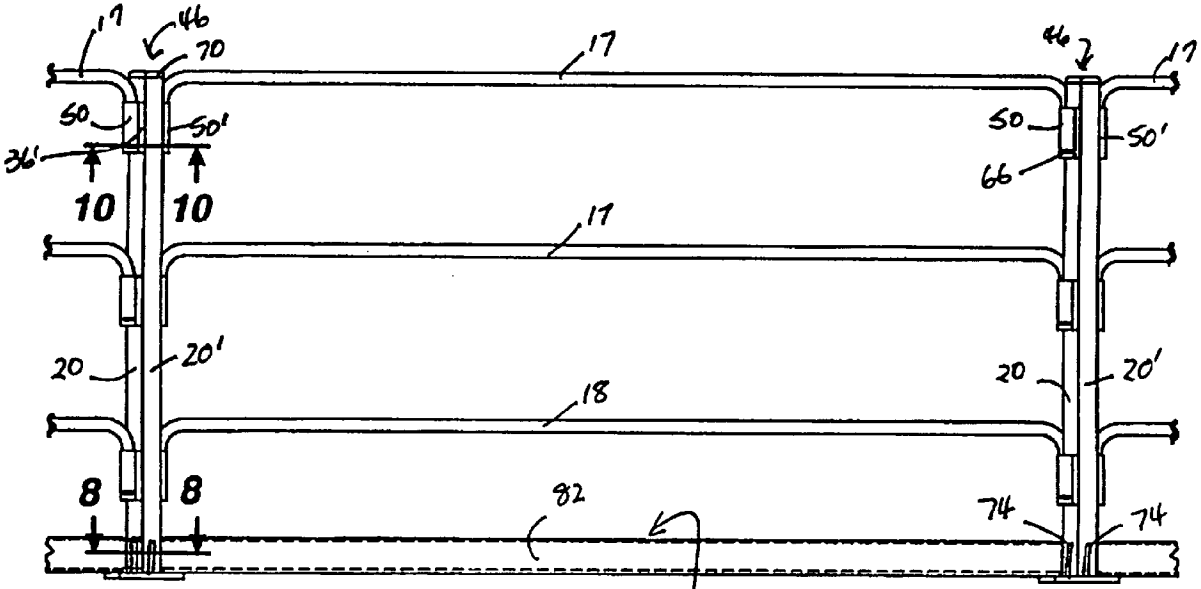
FIG. 7 is an elevation of the portion of the modular railing system depicted in FIG. 6.

In the preferred embodiments, a plurality of support pairs (double barrel support pairs 40 or single barrel support pairs 48) are suspended one above another in spaced configuration. For example, FIGS. 1–3, 6, 7, and 17 depict the use of double barrel support pairs 40. Looking in particular at FIG. 2, three double barrel supports 24 are welded to a first baluster 20 and three corresponding double barrel supports 2' are welded to a corresponding second baluster 20' of a baluster pair 22 at a preselected vertical spacing to achieve a desired vertical rail separation. Each double barrel support 24 in combination with its corresponding double barrel support 24' together comprise a double barrel support pair 40. As shown in FIG. 2, a first double barrel support 24 of a first double barrel support pair 40 is welded to the first baluster 20 of a baluster pair 22, and a corresponding first double barrel support 24' of the first double barrel support pair 22 is welded to the second baluster 20' of the baluster pair 22. These two double barrel supports 24, 24' are welded to their respective balusters 20, 20' at the same longitudinal position along the balusters 20, 20'. In FIG. 2, the balusters 20, 20' of a baluster pair 22 are "tied" together by multiple tie pipes 32 and a short section of kick rail 44. In this embodiment, each tie pipe 32 has one leg 34 inserted into one support 36 of a first double barrel support 24, and the other leg 38 inserted into one support 36' of a corresponding double barrel support 24'. As shown in FIGS. 6 and 7, for example, when double barrel supports 24, 24' are used, one support 36, 36' of each double barrel support 24, 24' accommodates one leg 34 of a tie pipe 32, and the other support 50, 50' can accommodate the connector portion 21 (FIGS. 2, 4, and 17) of a rail 17. As described further below, FIGS. 23–34 depict alternative baluster unit configurations where single barrel support pairs 48 are used. In each of these alternative baluster unit configurations, tie pipes 32 are not required. Thus, double barrel supports 24, 24' are unnecessary.

A long section of kick rail 52 (FIG. 2) is placed between one baluster 20, 20' from each of two adjacent baluster units 46. These long sections of kick rail 52 and the short sections of kick rail 44 mentioned above provide containment. Thus, if a worker on the lower horizontal surface 12 depicted in FIG. 1 were to drop a tool, it would be contained from rolling or being kicked off of the lower horizontal surface 12 by the short and long sections of kick rail 44, 52, respectively, connecting the lower ends of the balusters 20, 20'. In an alternative configuration, a single section of kick rail (not shown) that is longer than the long section 52 depicted in, for example, FIG. 2, extends between adjacent baluster units 46 in a manner that satisfies the containment function of the kick rails 44, 52. For example, the single, longer section of kick rail (not shown) could extend from the leftmost baluster 20 depicted in FIG. 2 to the baluster 20 that is second from the right in that figure, replacing one short section 44 and one long section 52, while continuing to provide the desired containment.

Figure 3:
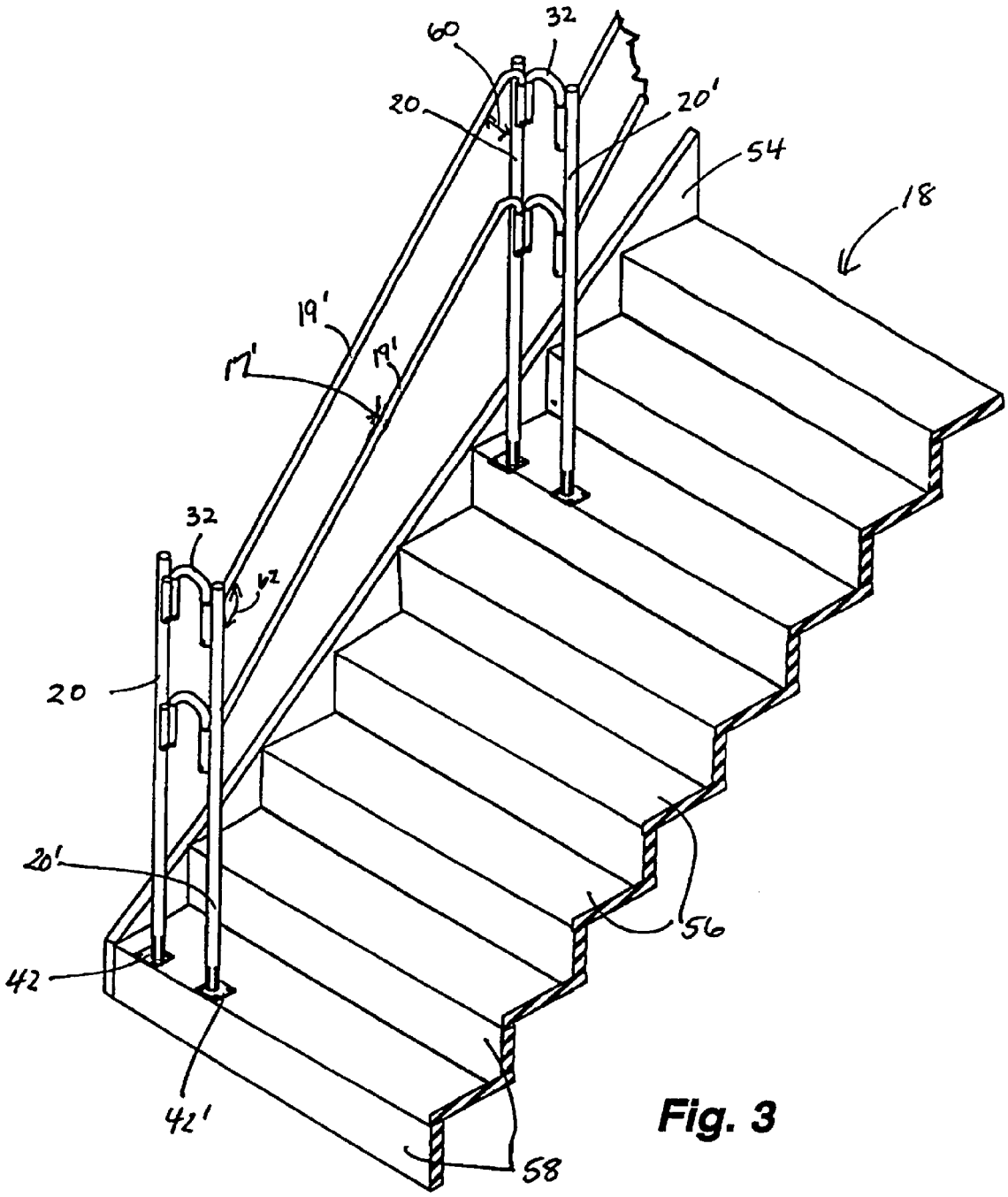
FIG. 3 is an enlarged fragmentary view of a portion of the section of the modular railing system depicted in FIG. 1 that is mounted on the staircase.

Referring next to FIG. 3, some details concerning the section of the modular railing system used on sloping surfaces like the depicted staircase 18 are described next. In FIG. 3, a portion of a staircase 18 is shown. As shown in FIG. 1, a stringer 54 is attached along each longitudinal edge of the treads 56 and risers 58 comprising the depicted staircase 18. In FIG. 3, only one stringer 54 is shown and is attached to the rear edges of the stair treads 56 and risers 58. The front stringer has been removed in this figure for clarity. Since the stringers 54 provide the containment that is provided by the kick rails 44, 52 on the substantially horizontal surfaces 12, 14 it is not necessary to use kick rails on each sloped staircase 18. Further, since workers are not permitted to walk on the steps of the staircase 18 with stilts, it is typically only necessary to provide two staircase rails 17' on the portions of the modular railing system 10 that are attached to staircases 18.

Another difference between the sections of the modular railing system used on substantially horizontal surfaces 12, 14 and the sections of the modular railing system used on sloped surfaces like staircases 18 comprises the relative angles 60, 62 (FIG. 3) between the elongated portion 19' of a staircase rail 17' and the connector portions 21' of the same rail 17'. Although the same balusters 20, 20' are used to support both horizontal rails 17 (e.g., FIG. 2) and inclined staircase rails 17' (e.g., FIG. 3), the rails themselves are different. For each horizontal rail 17, the end or connector portions 21 are bent 90° downwardly from the elongated horizontal portion 19 to form the vertical connector portions 21. For inclined applications (e.g., staircases 18), however, one vertical connector portion 21' of the staircase rail 17' forms an angle of approximately 130° with the inclined elongated portion 19' of the rail 17', and the other vertical portion 21' of the same staircase rail 17' forms an angle of approximately 60° with the inclined elongated portion 19'. These relative angles 60, 62 may vary somewhat, but the relative angle 60 between the elongated portion 19' and the connector portion 21' at an upper end of a rail 17' will be less than 90°, and the relative angle 62 at a lower end of the same rail 17' will be greater than 90°. Once one knows the aspect ratio of the staircase 18 (i.e., the length of the treads 56 vis-a-vis the height of the risers 58), the relative angles 60, 62 are easily calculated.

Figure 4:
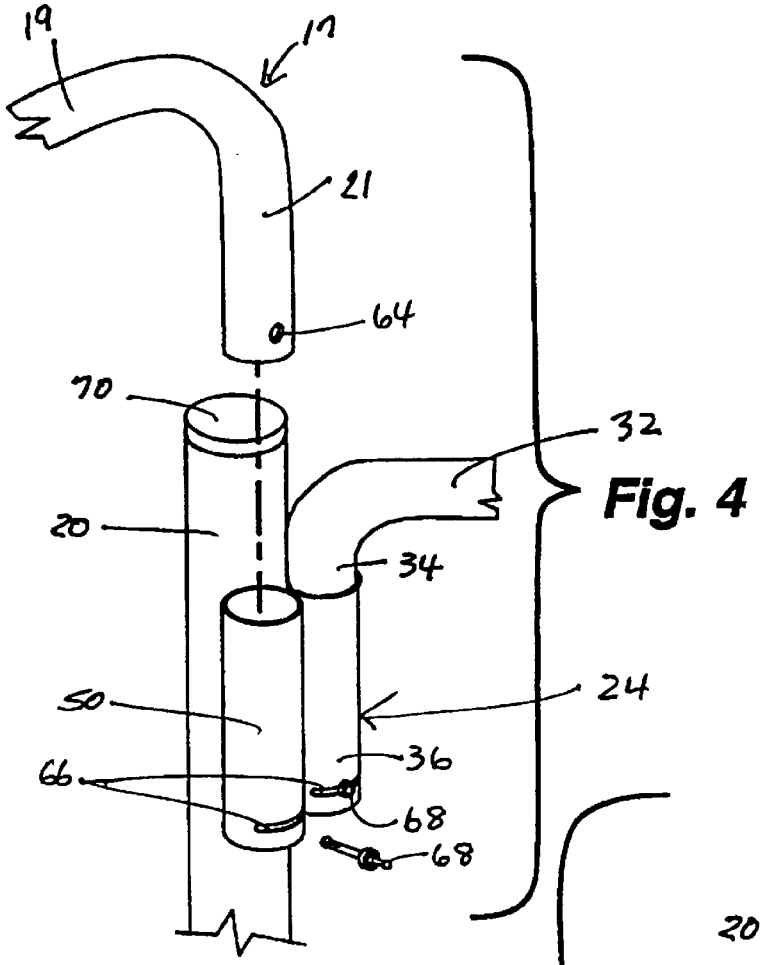
FIG. 4 is an enlarged, fragmentary, partially-exploded isometric view of a portion of the modular railing system depicted in FIGS. 1–3.

Referring next to FIG. 4, details concerning one preferred form for the interconnection of a rail 17 and a baluster 20 or of a tie pipe 32 and a baluster 20 are described next. FIG. 4 is a fragmentary, partially-exploded isometric view of the top end of one baluster 20. As shown in less detail in FIGS. 1–3, each baluster has a plurality of double barrel supports 24 attached thereto. In the preferred embodiment, each support 36, 50 of a double barrel support 24 is made from a section of circular pipe having an inside diameter sufficiently large to accommodate the outside diameter of a rail 17, 17' or tie pipe 32. In the preferred embodiment, the outside diameter of the rails 17, 17' is the same as the outside diameter of the tie pipes 32 so that a single inside diameter pipe may be used for each support 36, 50 of a double barrel support 24 attached to a baluster 20.

FIG. 4 depicts a first preferred technique for holding a rail 17, 17' or tie pipe 32 in a support 36, 50. As shown in FIG. 4, and as described further below, the rails 17, 17' and tie pipes 32 are held in position in a support 36, 50 using a combination of a retention hole 64, a rivet slot 66, and a rivet 68. For example, the retention hole 64 in the connector portion 21 of the rail 17 depicted in FIG. 4 is clearly visible. A similar retention hole (not shown) may be drilled on each leg 34, 38 of a tie pipe 32. During assembly, the rails 17 and tie pipes 32 are placed in the appropriate supports 36, 50 on the balusters 20. Once the modular railing system 10 is desirably positioned, rivets 68 are inserted through the rivet slots 66 in the supports 36, 50 and into the retention hole 64 in either a tie pipe 32 or connector portion 21 of a rail 17. The rivet slots 66 permit access to the retention holes 64 independent of the angular position of either the rail 17 or tie pipe 32 in the support 36, 50. The rivet 68 thus securely, but removably, secures the rail 17 or tie pipe 32 to a baluster 20. If desired, bolts, screws, or other similar connectors (not shown) could be used in place of the rivet 68 depicted in FIG. 4. Also depicted to clear advantage in FIG. 4 is a removable end cap 70. These removable end caps 70 are inserted into the top of each baluster 20, 20' to keep contaminates like water and construction debris from getting packed in the balusters 20, 20'. As will be discussed further below with reference to FIGS. 17 and 18, if baluster extensions 28, 28' are used, the end caps 70 are removed from the balusters 20, 20' and placed in the ends of the extensions 28, 28'.

Figure 5:
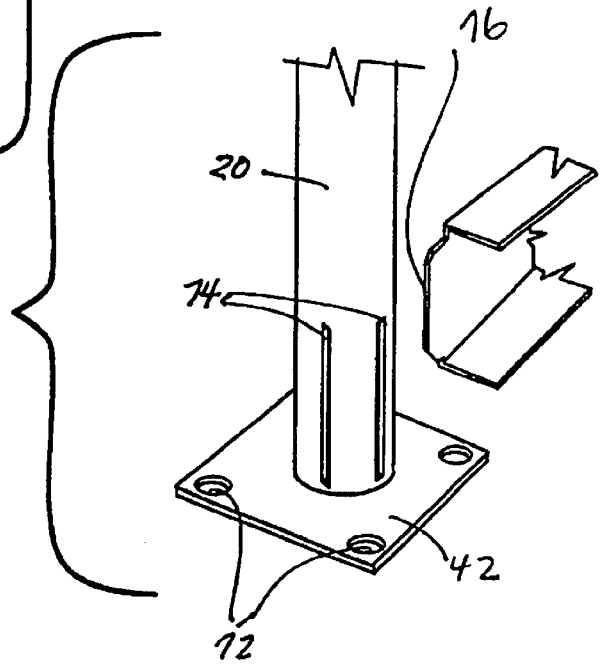
FIG. 5 is an enlarged, fragmentary, exploded isometric view of the lower end of a baluster and one end of a first embodiment of a kick rail.

FIG. 5 is a view similar to FIG. 4, but depicts the lower portion of a baluster 20. As shown in FIG. 5, a base plate 42 is affixed to the bottom of each baluster 20. In the preferred embodiment, the baluster 20 is centered on the base plate 42, but that is not required. For example, as shown in FIG. 3, the balusters 20, 20' may be offset slightly from the center of their respective base plates 42, 42'. When a baluster is offset slightly from the centers of its base plate, it may be possible to place that baluster closer to the edge of an attachment surface, whether that be a horizontal surface or a stair tread. As clearly shown in FIG. 5, each base plate 42 has a plurality of attachment holes 72. Nails or preferably bolts passing through the attachment holes are used to attach each base plate 42 to an attachment surface.

As shown in FIG. 5, a plurality of retention slots 74 are cut or stamped into the lower portion of each baluster 20. In the preferred embodiment, these retention slots 74 are spaced at approximately 90° intervals around the circumference of each baluster 20 as shown to good advantage in FIG. 15. Each kick rail 44, 52 in the preferred embodiments includes an alignment tab 76 that is inserted into one of the retention slots 74 during assembly. In the first preferred embodiment of the kick rails 44, 52, which is shown to best advantage in FIGS. 5, 8, and 9, these alignment tabs 76 on the ends of the various sections of kick rail are formed by cutting or punching during formation of the kick rails 44, 52. Alternatively, and most preferably, in a second preferred embodiment of the kick rails, the alignment tabs 76' are formed by crushing the ends of the kick rail as described more fully below in connection with FIGS. 19–22. As described further below in connection with FIGS. 8 and 9, the kick rails may be quickly assembled to the balusters by inserting the alignment tabs 76, 76' into appropriate retention slots 74. Each kick rail in the preferred embodiment is in the form of a C-beam having an upper flange 78 (FIG. 9) and a lower flange 80 (FIGS. 8 and 9) connected by a vertical member 82. A variety of cross-sectional configurations could, however, be used for the kick rails.

Referring next to FIGS. 6 and 7, further assembly details may be seen. FIG. 6 is a top plan view of the section of the modular railing system depicted in FIG. 2. Thus, FIG. 6 clearly shows many of the angular relationships between various components. For example, in the preferred embodiment, the long sections of kick rail 52 extend between one baluster 20 of two adjacent baluster units 46. In the preferred arrangement, the balusters 20, 21' of a baluster unit 46, two of such baluster units 46 being depicted in FIGS. 6 and 7, are positioned such that the double barrel supports 24, 24' on each baluster 20, 20' are facing one another, with the "outside supports" 36, 36' of each double barrel support pair 40 being directly across from each other. The "outside supports" 36, 36' are the ones that accommodate tie pipes 32. This permits the remaining support 50, 50' of each double barrel support 24, 24' to accommodate the connector portion 21 of a rail 17. The balusters 20, 20' of a baluster unit 46 are thus preferably positioned in a slightly offset configuration rather than directly across from each other. For example, in FIG. 7, which is an elevation taken substantially perpendicular to the plane of the depicted section of the modular railing system, the two balusters 20, 20' of each baluster unit 46 appear side-by-side rather than one behind the other. When connected properly, the tie pipes 32 help maintain the desired relative position of the balusters 20, 20' of a baluster unit 46 as does the short piece of kick rail 44 between the lower ends of the balusters 20, 20' of a baluster unit 46. As shown in FIG. 6, the long section of kick rail 52 forms a shallow X with the rails 17 mounted above that particular long section of kick rail 52. Also, as shown in FIG. 7, in the preferred embodiment, the elongated portion of each top rail extends above the top of the balusters to which it is connected.

Figure 9:
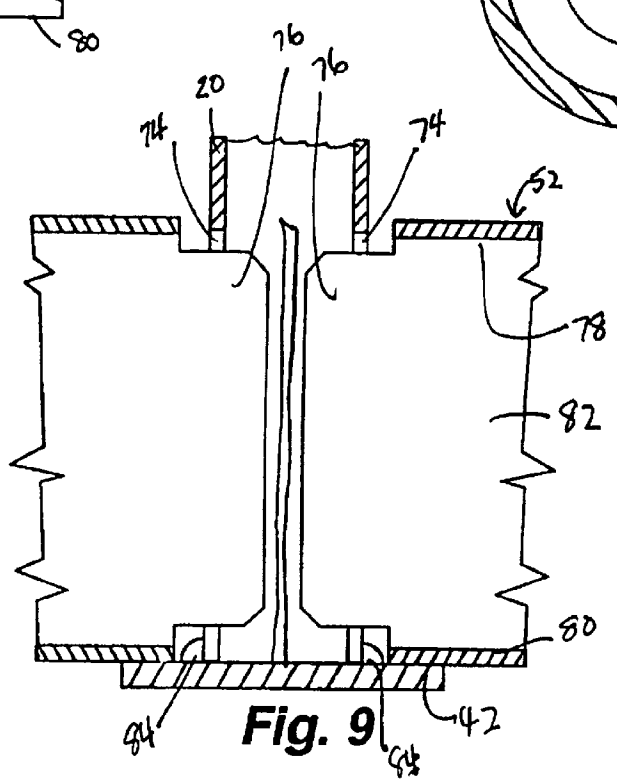
FIG. 9 is a fragmentary cross-sectional view of the lower portion of a baluster and two kick rails, taken along 9—9 of FIG. 8.
Figure 8:
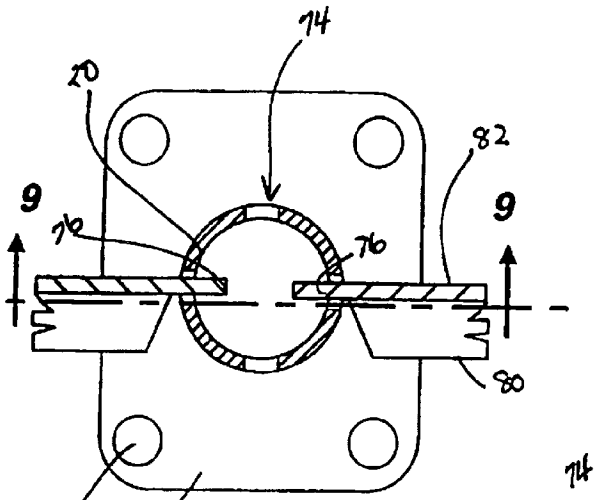
FIG. 8 is a fragmentary sectional view taken along line 8—8 of FIG. 7, including kick rail portions according to the first embodiment of the kick rails.

Referring next to FIGS. 8 and 9, details concerning the connection of the short and long kick rail sections 44, 52 to balusters 20, 20' is described next. The alignment tabs 76 are designed to fit within the retention slots 74 in the lower ends of each baluster 20, 20'. It is desirable to have the retention slots 74 in close proximity to the lowest end of the balusters 20, 20' so that the kick rails 44, 52 are as close as possible to the horizontal surface (e.g., the lower horizontal surface 12 depicted in FIG. 1) when the modular railing system 10 is fully assembled. This prevents objects from inadvertently slipping or rolling under the kick rails 44, 52 and defeating their safety (i.e., containment) purpose. As shown in FIG. 9, the kick rails may be notched on their ends, adjacent the alignment tabs 76. This notching not only clearly defines the alignment tabs 76, but also makes room for weld beads 84 that may be present at the union between the baluster 20 and its base plate 42.

Figure 10:
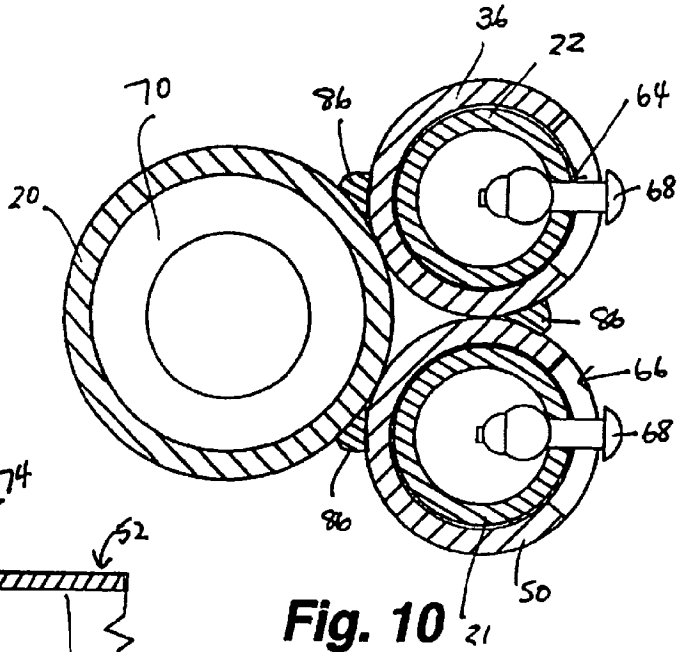
FIG. 10 is a partial cross-sectional view of a baluster and a double barrel support taken along line 10—10 of FIG. 7.

Referring next to FIG. 10, attachment of the supports 50, 36 of a double barrel support 24 to a baluster 20, and subsequent attachment of either a leg 34, 38 of a tie pipe 32 or a connector portion 21 of a rail 17 to its respective support 36, 50 is described next. In the first preferred embodiment, the supports 36, 50 of a double barrel support 24 are welded to a baluster 20 and to each other as shown by the three weld beads 86 in FIG. 10. Other known methods of attaching components could be used in place of the welding technique of the preferred embodiment without deviating from the present invention. For example, the supports could be attached to the baluster by a wire or band of metal (not shown) wrapped around the baluster 20 and the supports 36, 50. If the rivets 68 are tightly fastened, the rails 17 or tie pipes 32 may be substantially fixed in position after assembly is complete. If desired, however, the rivets 68 may be left slightly loose since the primary purpose of the rivets 68 is to keep the rails 17 and tie pipes 32 from inadvertently coming out of the supports 36, 50 rather than to rigidly fix the rails 17 and tie pipes 32 in a specific angular position within the supports 36, 50. When it is time to remove the modular railing system 10 of the present invention from a construction site, the rivets 68 may be cut or drilled out to permit removal of the rails 17 and tie pipes 32 from the supports 36, 50 and subsequent disassembly of the entire modular railing system. Clearly, bolts, screws, or other similar connectors could be used in place of the rivets 68.

Figure 38:
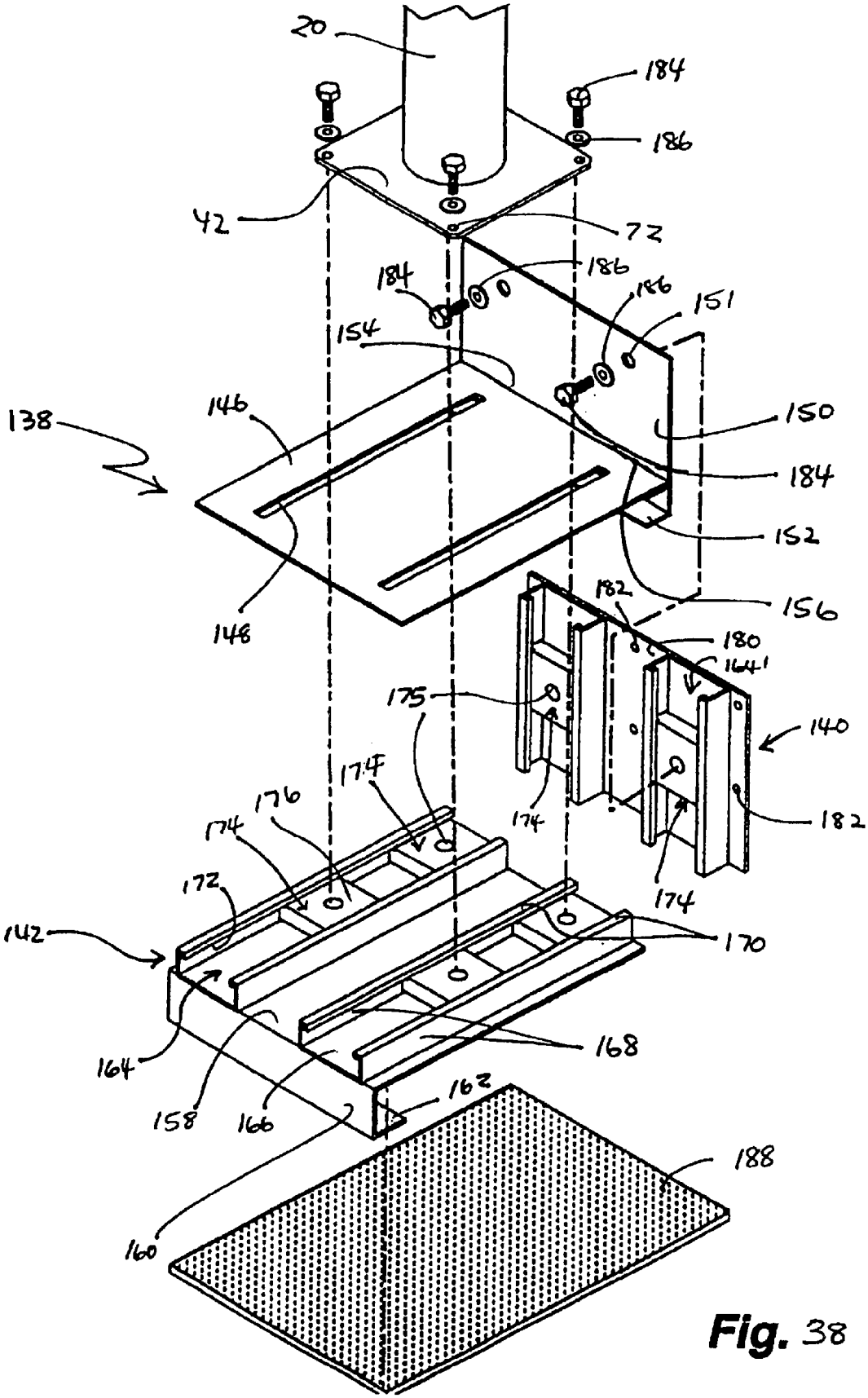
FIG. 38 is a further enlarged, exploded isometric view of a portion of a baluster and the components comprising the finished-stair-tread adapter shown assembled in FIG. 37.

Referring next to FIGS. 11–15, additional features of the balusters 20, 20' and supports 36, 50 in the present invention are described. As shown in FIGS. 11 and 13, the removable end cap 70 previously discussed is slipped into the top of each baluster 20. These removable end caps 70 could be made from, for example, a flexible plastic or rubber material so that, once in position, they resist easy removal to prevent them from inadvertently falling out of the balusters 20. As shown to best advantage in FIG. 14 and as previously discussed in connection with FIG. 10, in the preferred embodiment the supports are attached to a baluster by welding. As shown in FIG. 15, the preferred embodiment uses four attachment holes 72 through which base plate bolts (see e.g., FIG. 38) attach the base plates 42 to either a horizontal working surface 12, 14 or the top of the treads 56 in the case of rails 17' used on staircases 18. Although the base plate 42 design depicted in FIG. 15 has worked well in this preferred embodiment, myriad different configurations for the base plate 42 and the attachment holes 72 could be used without deviating from the scope of the present invention.

FIG. 16 depicts another embodiment of a baluster 20 according to the present invention. This baluster could be used on a staircase 18 where three rails are not required. It could also be used in construction situations where the extra height provided by the three-rail system shown in, for example, FIGS. 1, 2, and 7 is not mandated by the OSHA regulations.

Figure 17:
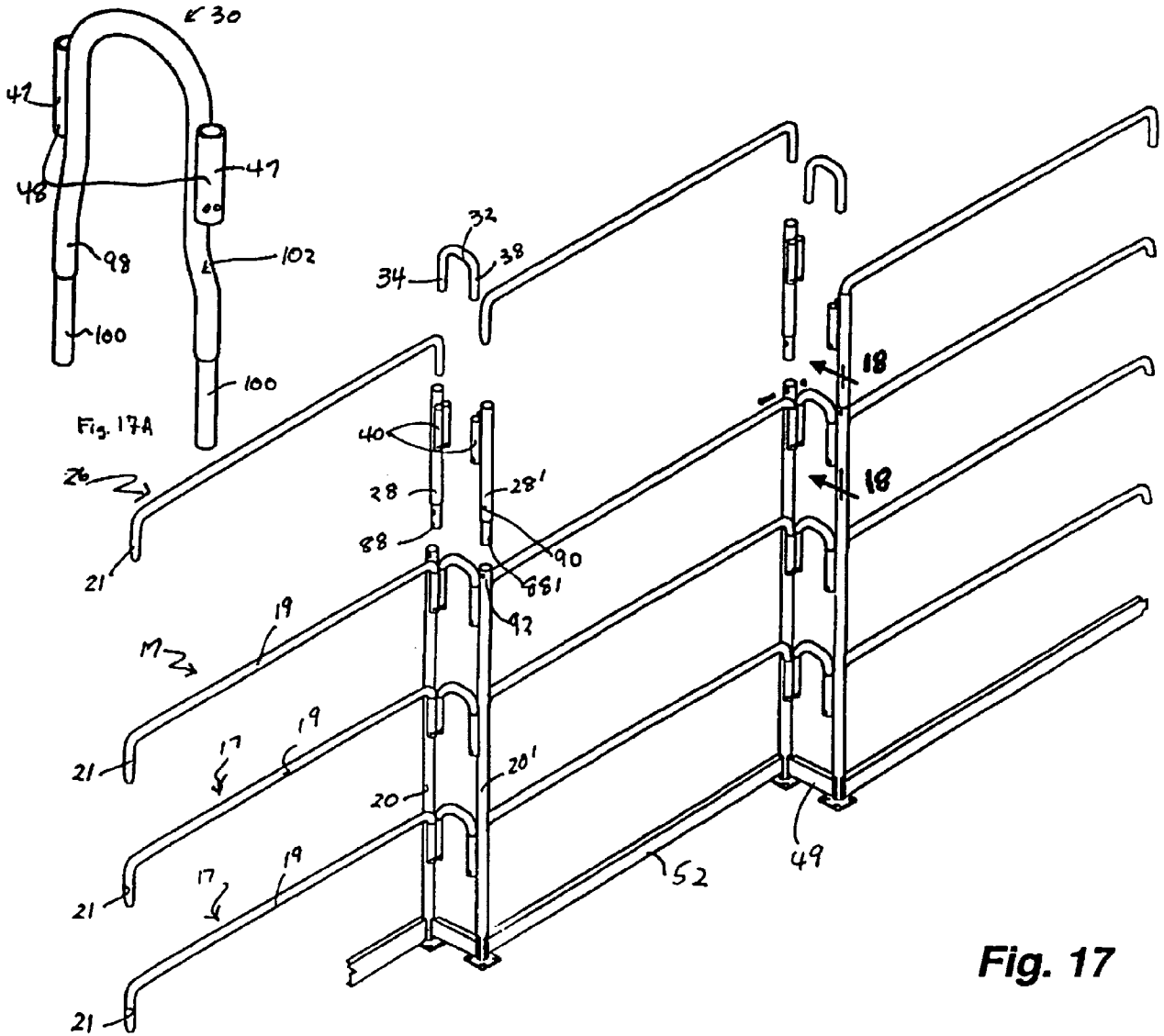
FIG. 17 is similar to FIG. 2, but depicts extensions that may be used in the modular railing system of the present invention to add an additional rail.
Figure 23:
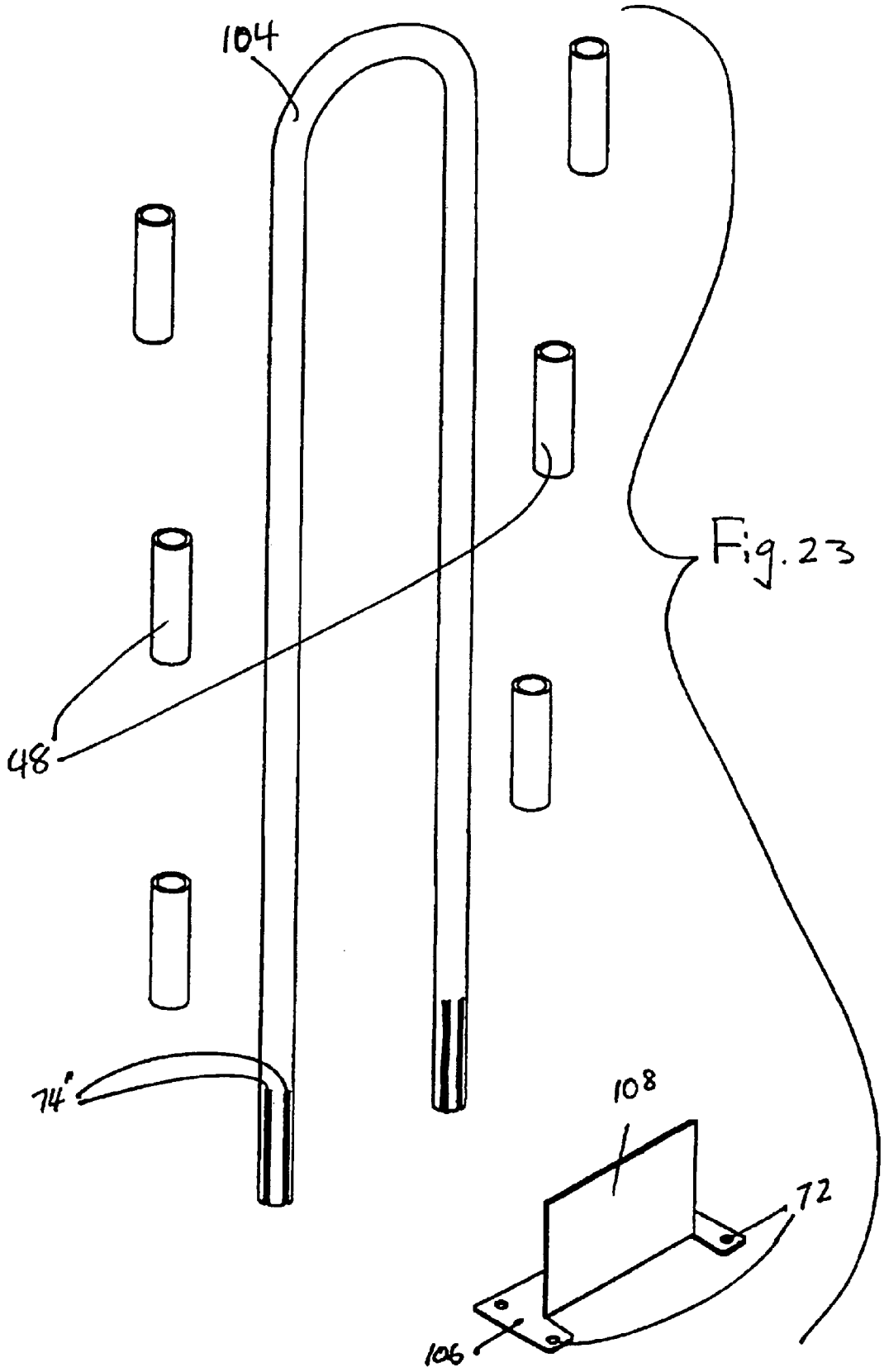
FIG. 23 is an exploded isometric view of a first alternative baluster unit according to the present invention.
Figure 24:
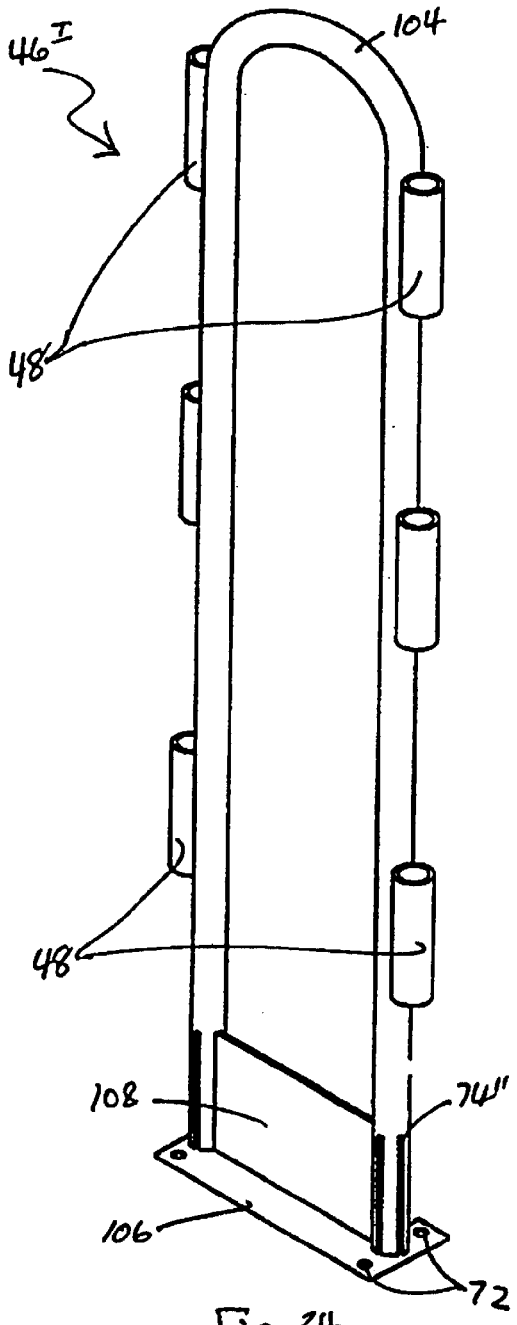
FIG. 24 is an assembled isometric view of one side of the first alternative baluster unit depicted in FIG. 23.
Figure 25:
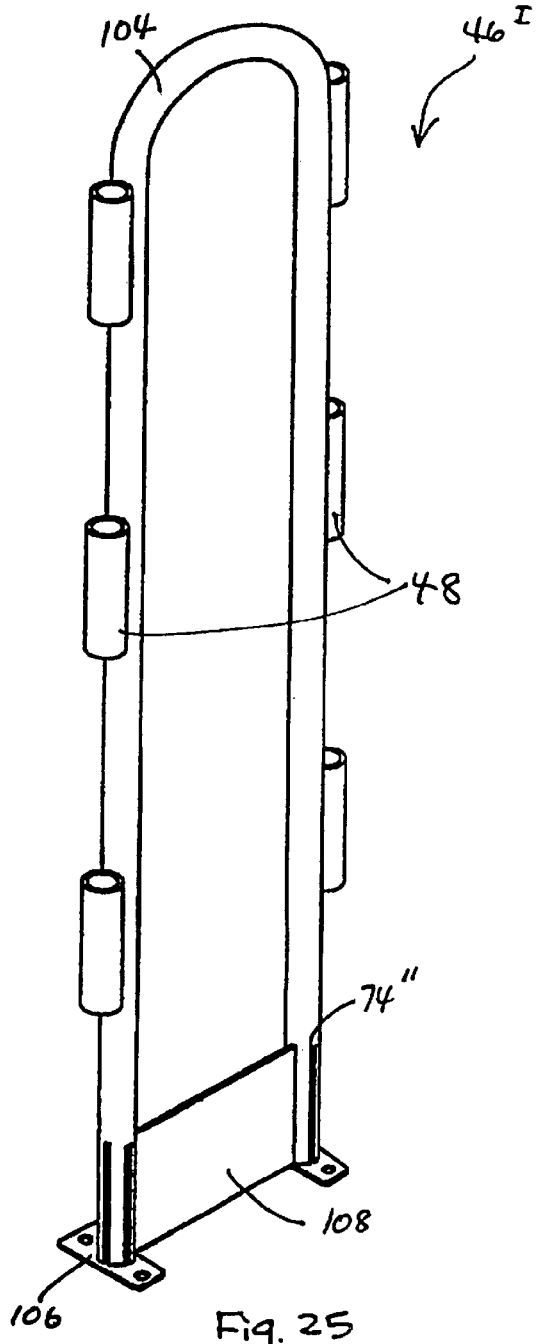
FIG. 25 is similar to FIG. 24, but depicts the first alternative baluster unit from the opposite side.
Figure 26:
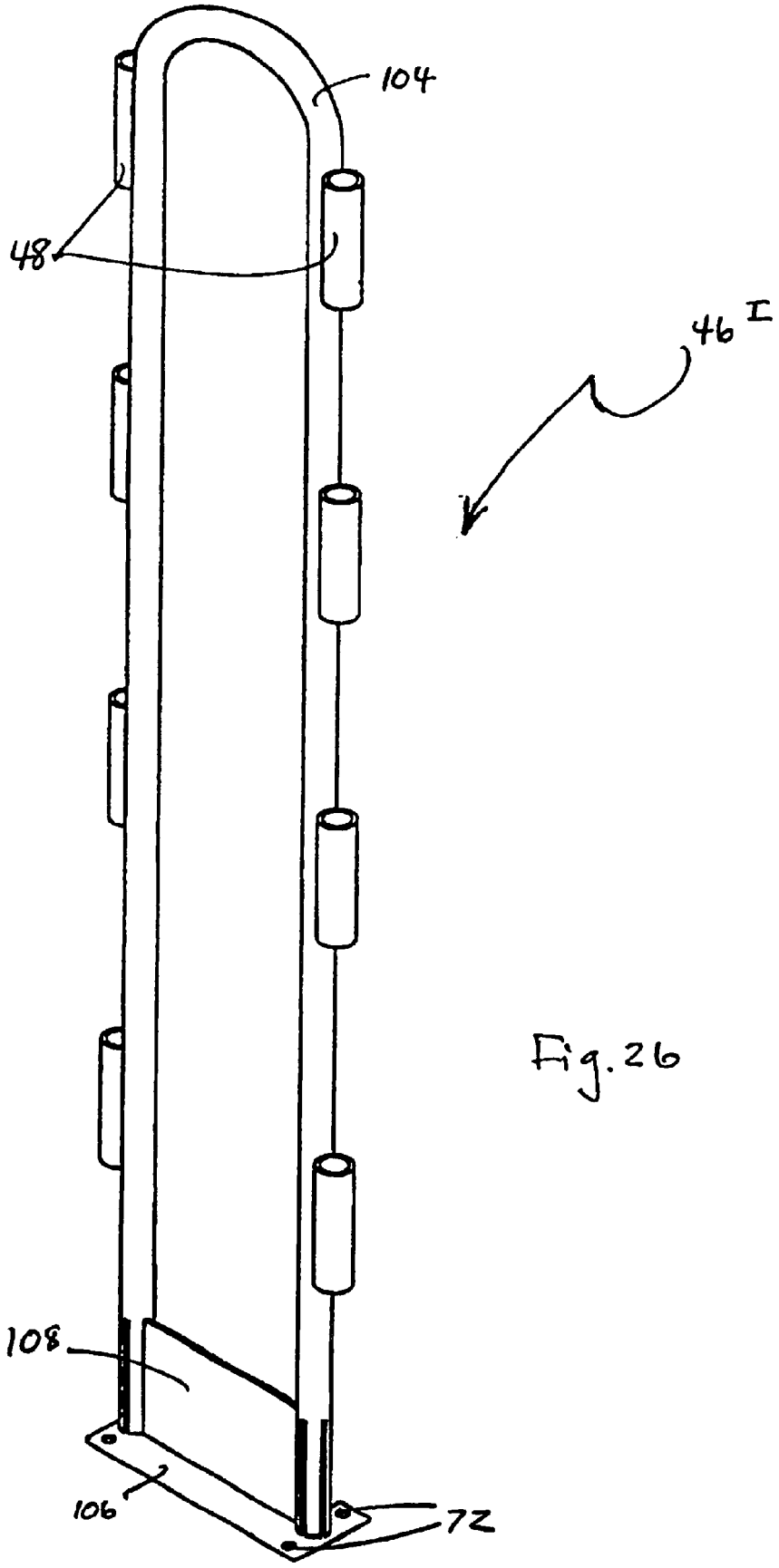
FIG. 26 is similar to the baluster unit depicted in FIGS. 23–25, but depicts a baluster unit having four support pairs rather than tree.

Referring next to FIGS. 17 and 18, baluster extensions 28, 28', which permit the ready attachment of an additional rail, are described next. If, for example, a fourth rail 26 were desired or required to be added to the modular railing system 10 depicted in FIG. 2, a plurality of extensions 28, 28' could be inserted into the balusters 20, 20' depicted in FIG. 2 to facilitate the addition of a fourth double barrel support pair 40 to accommodate additional tie pipes 32 and fourth rails 26. It should be noted that the extensions 28, 28' depicted in FIGS. 17 and 18 could also be used with the shorter baluster depicted in FIG. 16 to add a third rail.

As shown to best advantage in FIG. 18, the lower end 88 of an extension 28 is wedged or otherwise reduced to fit into the upper end of a corresponding baluster 20. For example, the removable end cap 70 (see FIGS. 4 and 12) could be removed from the upper end of a baluster 20 and placed into the upper end of an extension 28. Then, the tapered lower end 88 of the extension 28 could be placed into the now open upper end of the baluster 20. In the preferred embodiment for the extensions 28 depicted in FIGS. 17 and 18, a substantially horizontal hole 90 passing through the tapered lower end 88 of the extension 28 aligns with a corresponding hole 92 in the upper end of the baluster 20. Thus, when the extensions 28, 28' are inserted into the upper ends of the balusters 20, 20', a retention bolt 94 and nut 96 combination may be used to removably retain the extensions 28, 28' in the balusters 20, 20'. Alternatively, rivets, screws, or other similar connectors could be used in place of the depicted retention bolt 94 and nut 96 combination, particularly since the selected connector will not be required to bear any substantial shear stress. Preferably, if the extensions 28, 28' are used to create the four-rail modular railing system depicted in FIG. 17, the center of the top rail 26 is approximately eighty-four inches above the surface to which the balusters are attached. The balusters 20, 20' of a baluster unit 46 are preferably placed twelve inches apart in such a four-rail modular railing system.

FIG. 17A depicts an extender bar 30, which provides an alternative technique to that shown in FIGS. 17 and 18 for adding an additional rail. The extender bar 30 comprises a main bar 98 that is bent into a configuration that resembles a lower case letter "N" having legs with tapered lower ends 100. Each leg of the main bar 98 is depicted as also having a shoulder or slight inward jog 102 formed therein between the respective single barrel rail support 47, which is preferably welded to the main bar 98, and tapered lower end 100. These jogs 102 can provide additional rigidity to the extender bar 30 or help position the single barrel supports 47 to receive the connector portions 21 of an added top rail. The extender bar 30 is designed primarily for embodiments having vertical baluster tubes 20, 20' (e.g., the embodiments depicted in FIGS. 2, 7, 17, 27, 28, 33, and 34) that permit insertion of the tapered lower ends 100 of the extender bar 30 into the upper ends of the vertical balusters 20, 20' to add a fourth rail 26. Alternatively, if the first alternative baluster unit 46' depicted in FIGS. 23–26, which does not have a vertical baluster tube 20, were modified to use a double barrel support pair 40 at least in place of the top single barrel support pair 48, then the extender bar 30 depicted in FIG. 17A could also be used with this type of baluster unit. The extender bar 30 depicted in FIG. 17A would work as well, or better in certain applications, without the jog 102. For example, this "jogless" extender bar (not shown) would work well with embodiments that have vertical baluster tubes 20, 20'.

FIGS. 19–22 depict an alternative kick rail alignment tab 76'. FIG. 19 is most similar to FIG. 5. When the alignment tabs 76' according to the second preferred embodiment for them are used, the retention slots 74' may need to be slightly larger. This up-sizing of the retention slots 74' may be seen from a close comparison of FIGS. 5 and 19. The retention slots 74' must be made slightly larger since the alignment tabs 76' according to the second preferred embodiment for them are formed by crushing the ends of the kick rails 52. In particular, as shown to good advantage in FIG. 20, a portion of the upper flange 78 and a portion of the lower flange 80 are crushed against the vertical member 82 of the kick rail 52 to form the alternative embodiment for the alignment tabs 76'. FIG. 21 is a fragmentary end view along line 21—21 of FIG. 20 and clearly depicts the crushed portions of the upper and lower flanges 78, 80 being pressed against the vertical member 82 of the kick rail 52. FIG. 22 is a fragmentary cross-sectional view along line 22—22 of FIG. 20 of an uncrushed portion of kick rail. The embodiment of the alignment tabs 76' depicted in FIGS. 19–22 are preferred over the embodiment of the alignment tabs 76 depicted most clearly in FIGS. 5, 8, and 9. The alignment tabs 76' depicted in FIGS. 19–22 are simpler to manufacture.

FIGS. 23–34 depict alternative ways to make baluster units. In FIGS. 23–26, a first alternative baluster unit 46I according to the present invention is depicted. As shown, each such baluster unit 46I comprises a U-shaped main baluster tube 104, which is inverted and then welded to an elongated base plate 106. In this particular embodiment, the base plate 106 includes an integrated short kick rail 108, the lateral ends of which are accommodated by retention slots 74" on the distal ends of the main baluster tube 104. Alternatively, the short kick rail could be welded to the base plate rather than comprising an integral part thereof.

Figure 27:
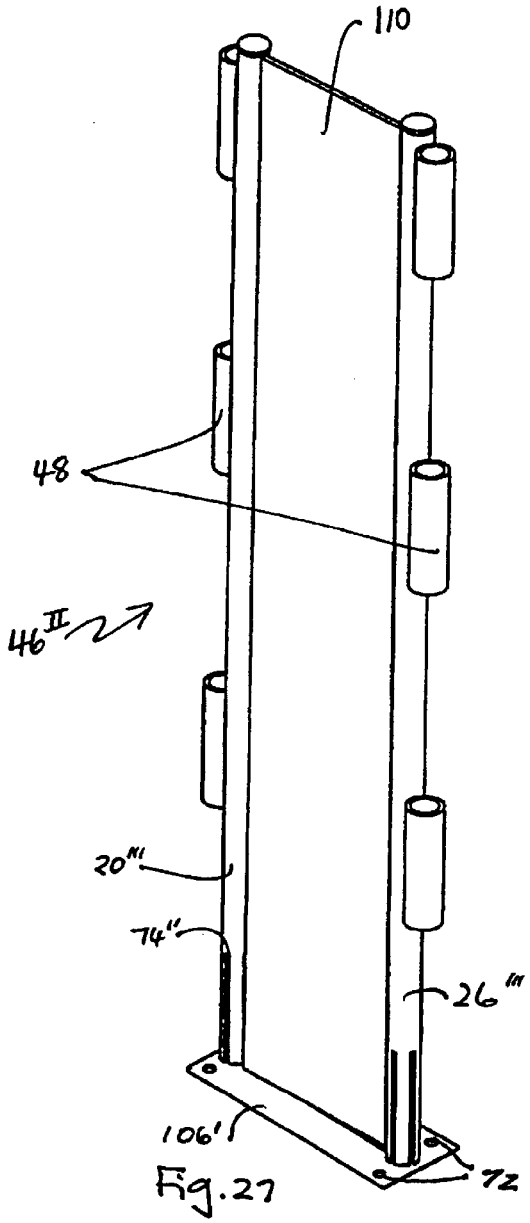
FIG. 27 is an isometric view of a second alternative baluster unit according to the present invention.
Figure 28:
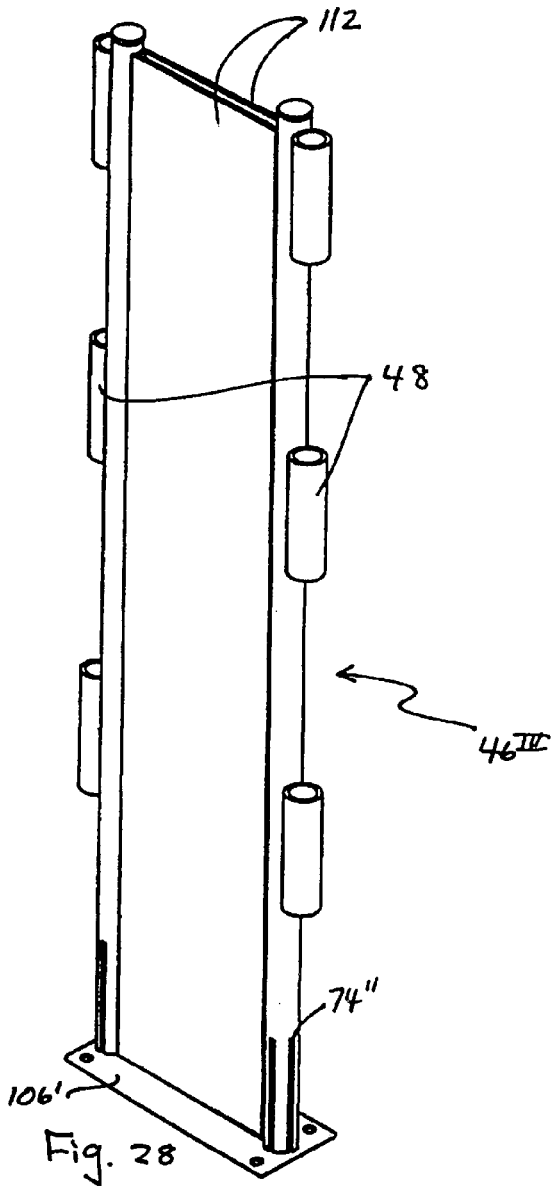
FIG. 28 is an isometric view of a third alternative baluster unit according to the present invention.

FIG. 27 depicts a second alternative baluster unit 46II according to the present invention, and FIG. 28 depicts a third alternative baluster unit 46III according to the present invention. In these figures, the "baluster unit" comprises two vertical baluster tubes 20" sharing a single, common base plate 106'; a plurality of single barrel support pairs 48; and a single elongated web 110 (FIG. 27) or a pair of elongated webs 112 (FIG. 28). Retention slots 74" are formed at 90° intervals around the lower ends of the two vertical balusters 20".

Figure 29:
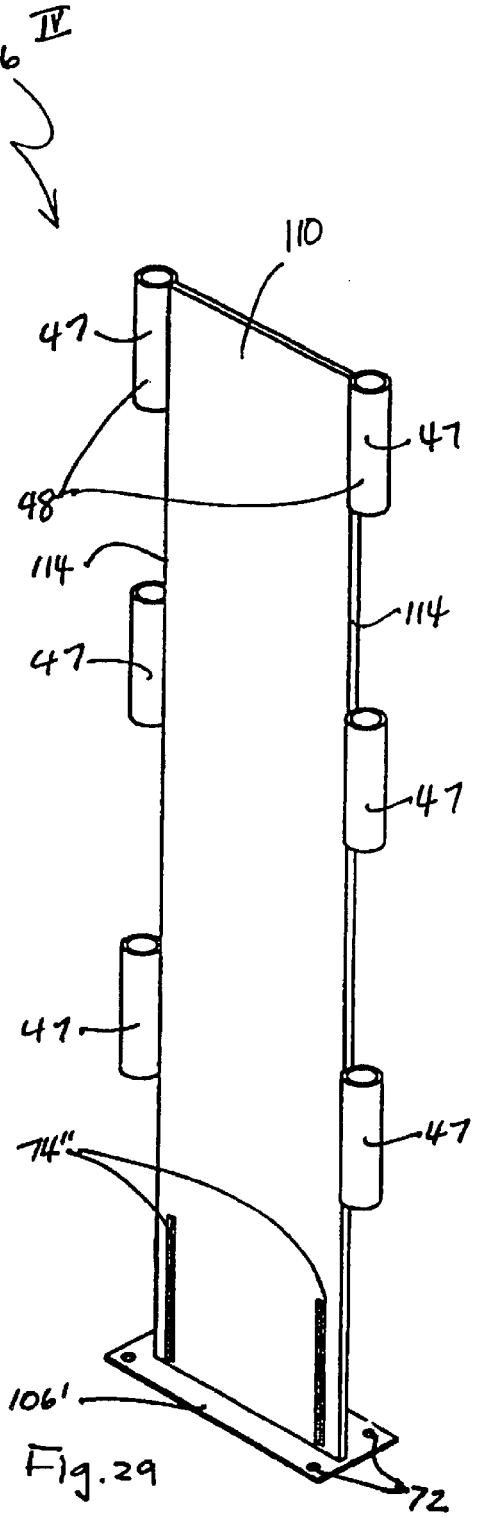
FIG. 29 is an isometric view of a fourth alternative baluster unit according to the present invention.
Figure 30:
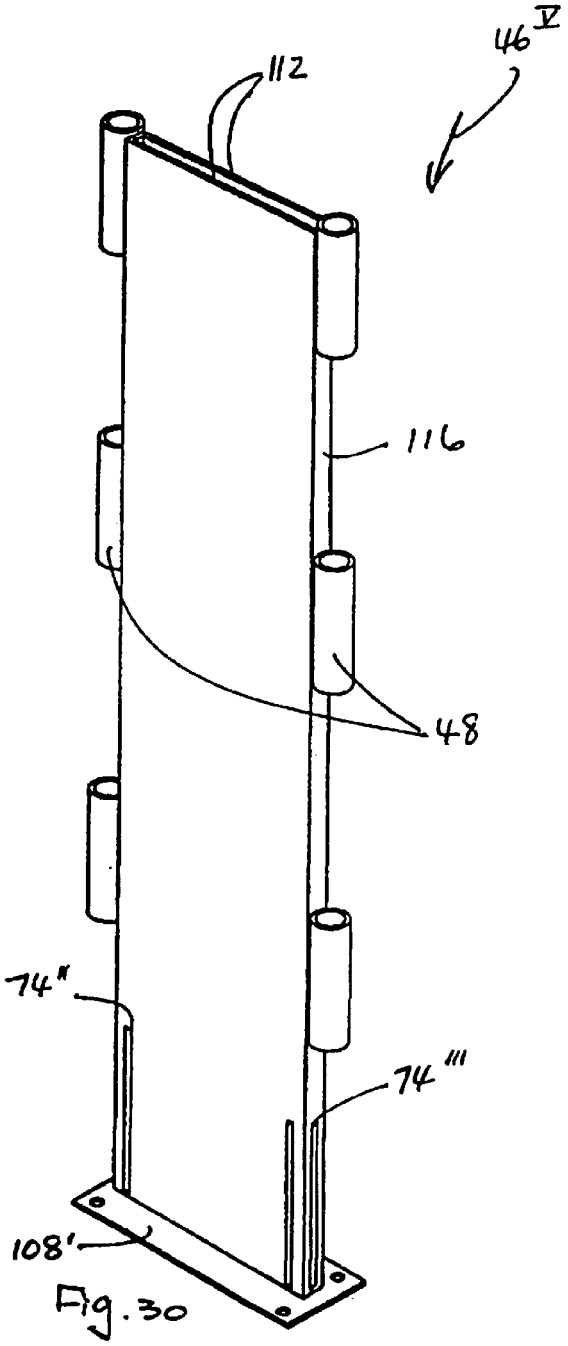
FIG. 30 is an isometric view of a fifth alternative baluster unit according to the present invention.

FIGS. 29–32 depict, respectively, fourth, fifth, sixth, and seventh alternative baluster units 46IV, 46V, 46VI, 46VII according to the present invention. These baluster units do not use vertical baluster tubes. The "baluster units" depicted in FIGS. 29 and 30 are similar to those depicted in FIGS. 27 and 28, respectively. In the embodiments of FIGS. 29 and 30, however, the three single barrel support pairs 48 are directly welded to edges 114 of an elongated web 110 (FIG. 29) or to narrow web strips 116 that perpendicularly join first and second elongated webs of an elongated web pair 112, thereby forming a narrow "box beam" configuration (FIG.

30). The retention slots 74" for the kick rails are formed in the elongated web or webs. Additionally, in FIG. 30, an additional retention slot 74" may be formed in the narrow web strips 116.

Figure 31:
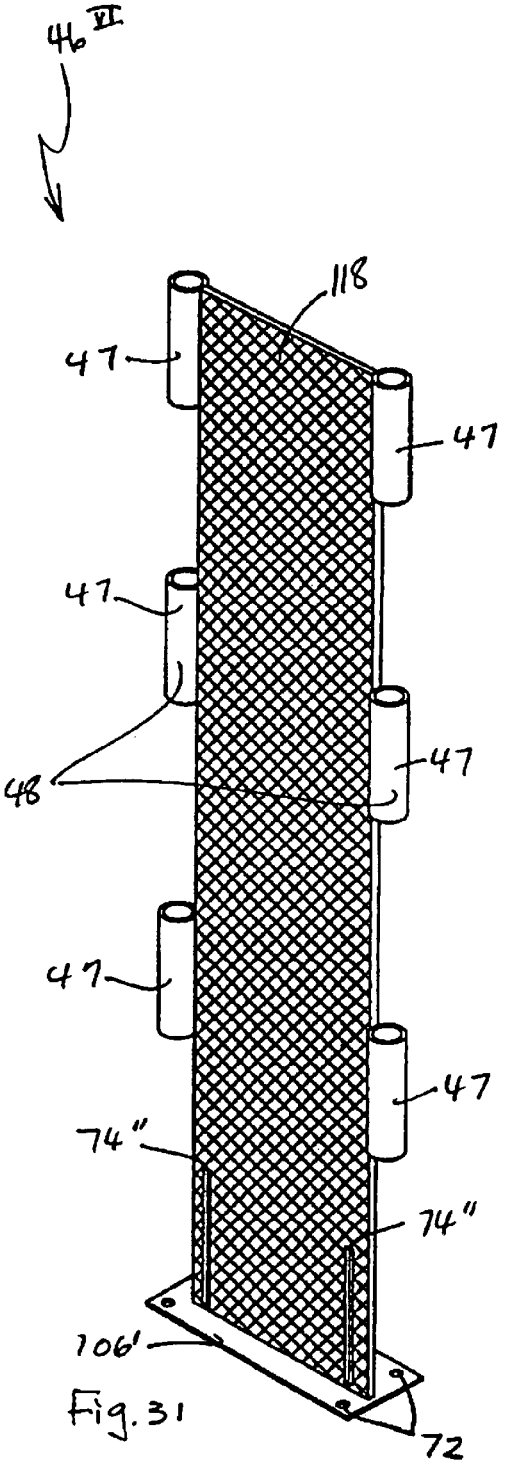
FIG. 31 is an isometric view of a sixth alternative baluster unit according to the present invention.
Figure 32:
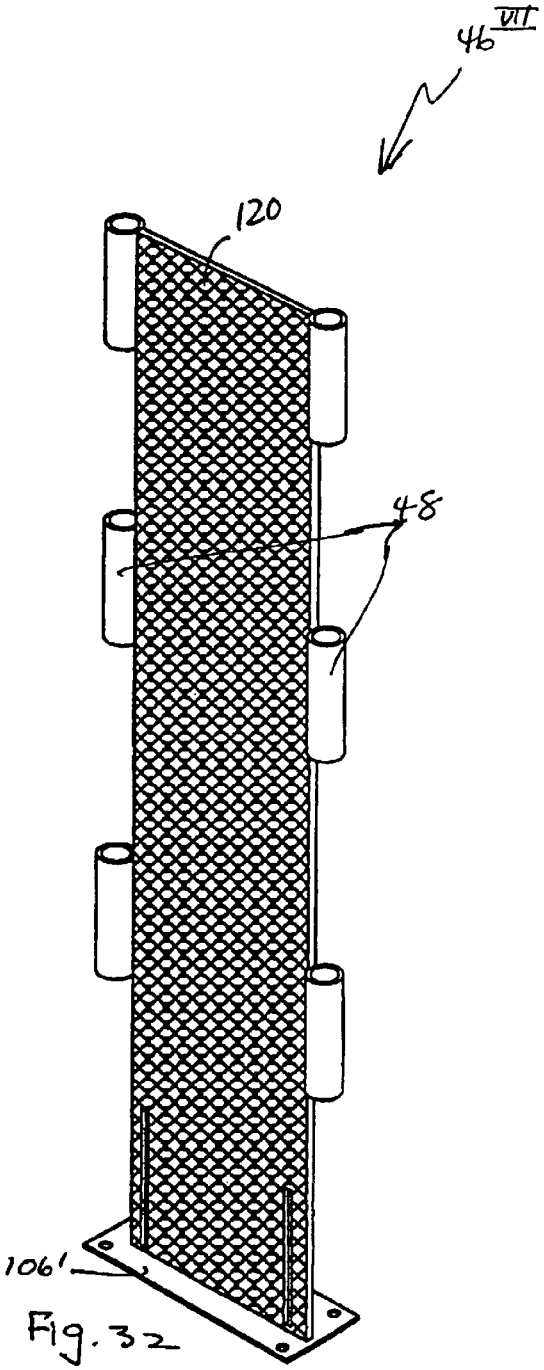
FIG. 32 is an isometric view of a seventh alternative baluster unit according to the present invention.

The "baluster units" depicted in FIGS. 31 and 32 are most similar to the "baluster unit" depicted in FIG. 29. In FIG. 31, however, which depicts the sixth alternative baluster unit 46VI according to the present invention, the plain elongated web 110 (FIG. 29) has been replaced by an elongated mesh web 118 having retention slots 74" formed near a lower end thereof. In FIG. 32, the plain elongated web 110 depicted in FIG. 29 has been replaced by an elongated decorative metal web 120 (e.g., "diamond plate"). The mesh web 118 or the decorative web 120 could also be formed into a narrow box beam configuration like that shown in FIG. 30.

Figure 33:
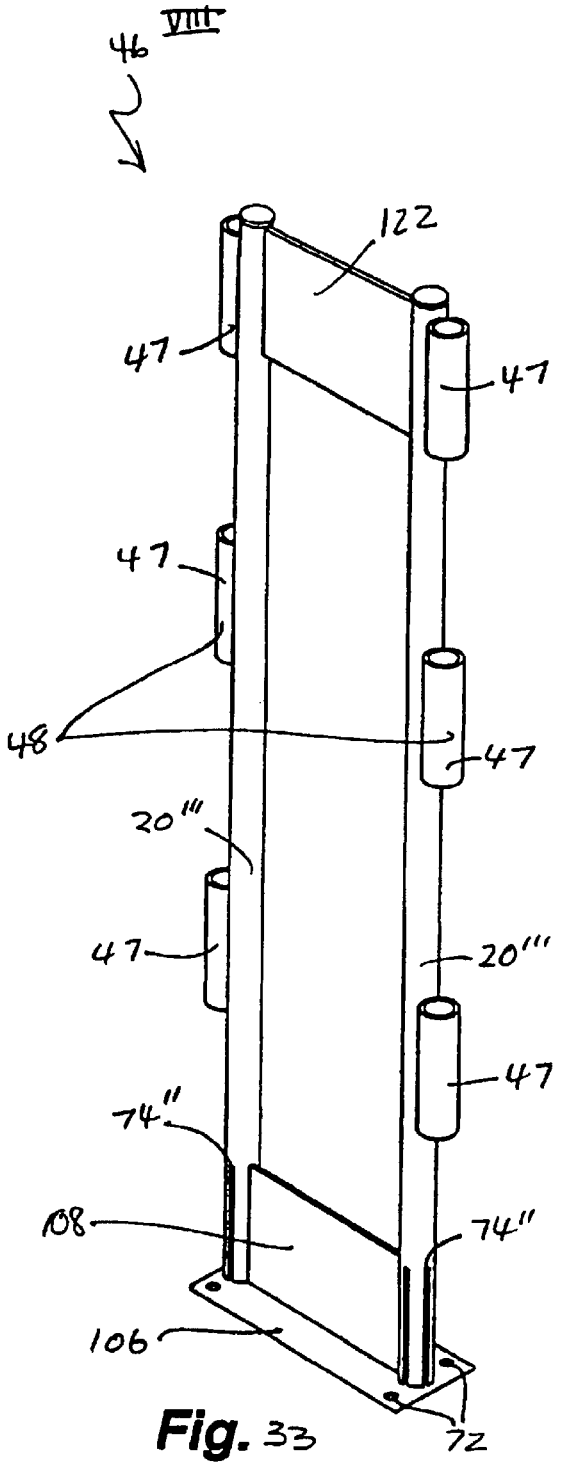
FIG. 33 is an isometric view of an eighth alternative baluster unit according to the present invention.
Figure 34:
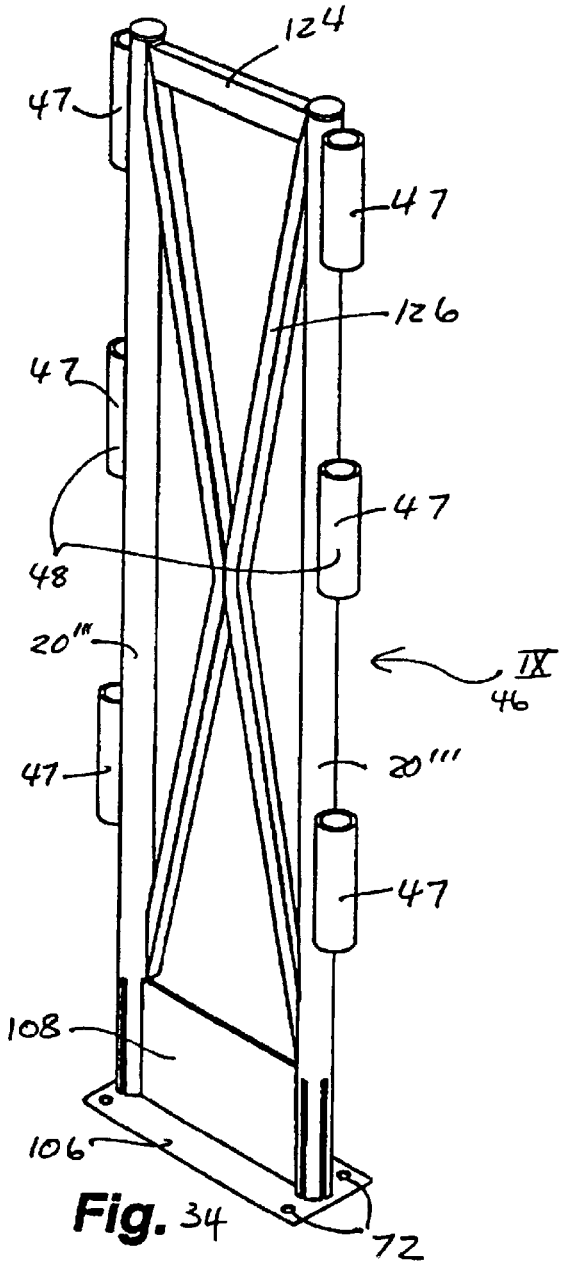
FIG. 34 is an isometric view of a ninth alternative baluster unit according to the present invention.

In FIG. 33 is shown an eighth alternative baluster unit 46VIII according to the present invention. This baluster unit is most similar to the baluster unit 46II shown in FIG. 27. In the embodiment of the baluster unit 46VIII depicted in FIG. 33, however, the single elongated web 110 has been replaced by two smaller web sections 108, 122. The lower of these web sections 108 serves as a kick rail and could be integrally formed with the common base plate 106. The upper of these smaller web sections 122 ties the two vertical baluster tubes 20" together. The baluster unit 46IX shown in FIG. 34 is similar to the baluster unit 46VIII embodiment shown in FIG. 33, but the upper web section 122 has been replaced with a horizontal support piece 124 welded between the two vertical baluster tubes 20". In this ninth alternative embodiment, an X-shaped structural support member 126 also has been welded between the two vertical baluster tubes 20". In view of the X-shaped structural support member 126, the horizontal support piece 124 is not required, but provides additional structural integrity.

Figure 35:
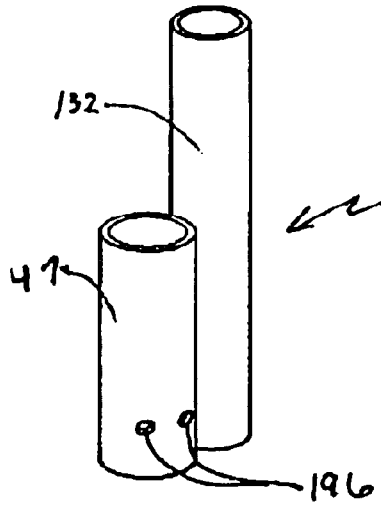
FIG. 35 is an isometric view of a stair rail adjuster and depicts the use of rivet holes rather than the single rivet slot shown in, for example, FIG. 4.

FIGS. 35–43 depict components used to attach a railing system to straight and curved staircases, particularly those having finished treads. The "stair rail adjuster" 128 depicted in FIG. 35 is required to adjust the height of the upper end of inclined rails 17' when the balusters 20 are used on staircases 18 as shown in, for example, FIG. 36. Typically, in a two-rail system, the rails must be twenty-one inches apart. Thus, in the embodiment shown in FIG. 36, the top rail would be forty-two inches above the stair treads 56. OSHA regulations, however, provide that, when stairs are railed and the top horizontal rail acts as the handrail, that handrail must be ±one inch from thirty-six inches above the nose or leading edge 130 of the stair tread 56. The leading edge 130 typically sticks out 1½ inches from the riser 58 of the next lower step. To make it possible to use a standard baluster 20 on staircases 18, a stair rail adjuster 128 must be used to bring the top rail height down from forty-two inches to thirty-seven inches above the leading edge 130 of the stair tread 56 to comply with OSHA requirements. Since the risers 58 are typically five inches high, this results in the upper rail being thirty-seven inches from the nose 130 of the stair treads 56 along the entire length of the top rail.

Although the stair rail adjuster 128 is designed to decrease the vertical distance between the upper end of an inclined rail 17' and the nose 130 of the tread 56 by approximately five inches, additional vertical adjustability is available since the longer cylindrical piece 132 of the stair tread 128 adapter rides in one side of the double barrel support 24. Also, the stair rail adapter 128 may be pivoted within the one side of the double barrel support 24 to account for varying distances between one baluster and the next. In particular, stair treads must be at least nine inches deep, but are typically ten inches or ten and one-half inches deep. Since the stair rail adjuster may be pivoted in the double barrel support 24 in which it is mounted, it is unnecessary to have as many different lengths of rail 17' to select from to accommodate a wide variety of staircases 18. Whereas the horizontal rails 17 are preferably made in six inch increments to accommodate as many installation scenarios as reasonably possible, the staircase rails 17' used for incline applications are manufactured in ten inch increments based upon the fact that most stair treads 56 are ten inches deep. The ability to pivot the stair rail adapter 128 in one support of the double barrel support 24 allows the system to accommodate different stair tread depths and irregularities, even though there is preferably a limited number of rail lengths from which to choose.

Referring most particularly to FIGS. 36–41, a finished-stair-tread adapter 134, which is used to rail both straight and curved staircases, is shown. The finished-stair-tread adapter 134 may be used on any staircase built to the requirements of the universal building code, including straight staircases (FIG. 36), curved staircases (FIG. 42), circular staircases, switchback staircases, and even irregular staircases, but it is particularly useful for finished stairs (e.g., oak hardwood), which have previously been difficult to rail. It may also be used whether the leading edge of the stair tread is squared (e.g., FIGS. 36, 37, and 39) or rounded (e.g., FIG. 40). If a standard railing system attachment is used, it causes unsightly blemishes to the to-be-finished stair treads. In particular, most railing systems require large lag screws or bolts that unacceptably mar finished treads 56. As discussed further below, a standard single baluster 20 mounts on the finished-stair-tread adapter 134, which is then mounted on a stair tread 56 using one screw 136 into the riser 58. This permits the attachment of any standard baluster 20 on any staircase 18, including high-end staircases that are themselves finished rather than being carpeted over.

Figure 39:
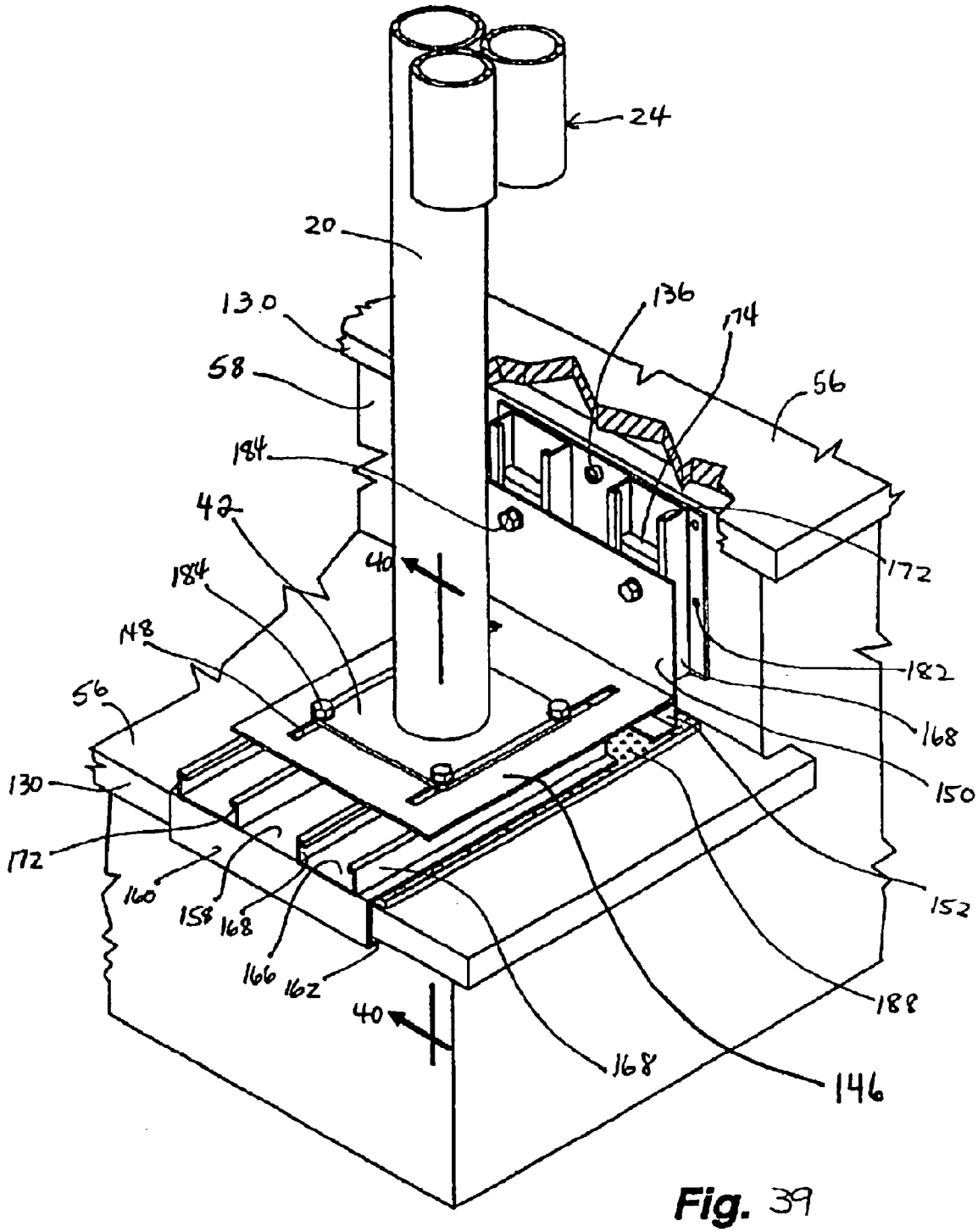
FIG. 39 is similar to FIG. 37, but depicts the baluster and finished-stair-tread adapter combination affixed to a staircase with a portion of the upper stair tread broken away for clarity.
Figure 40:
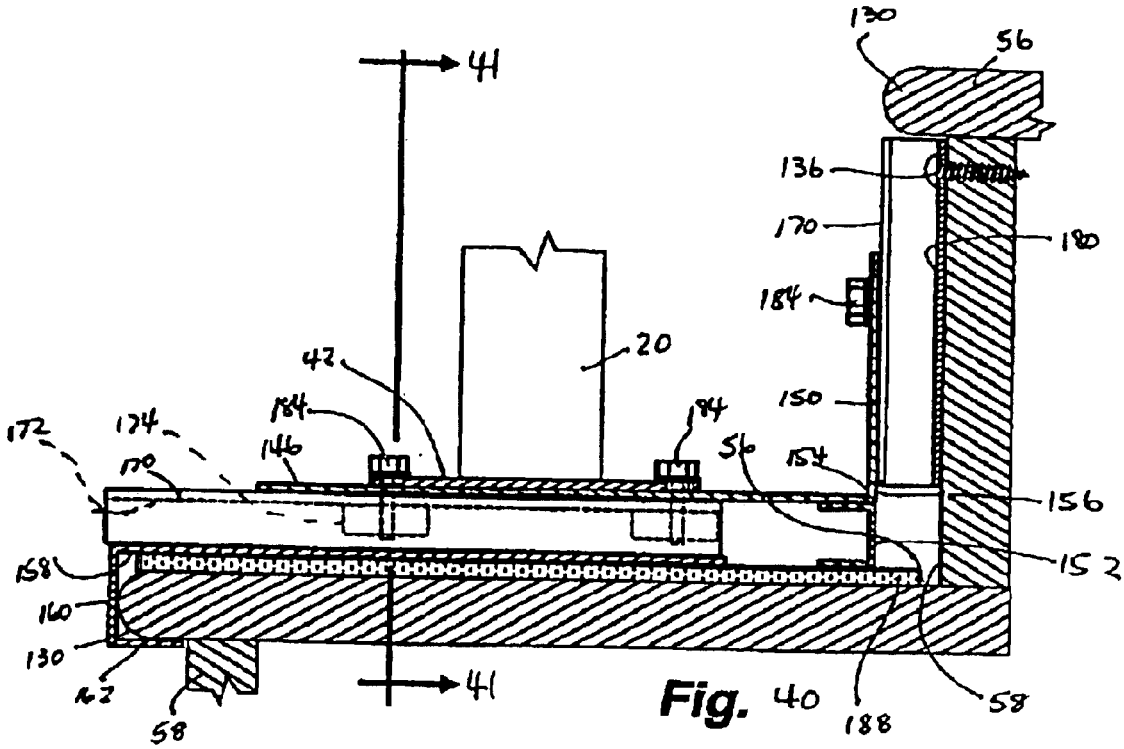
FIG. 40 is a fragmentary, cross-sectional view taken along line 40—40 of FIG. 39, but depicting stair treads having rounded leading edges.

Referring to FIGS. 36–43, details concerning the finished-stair-tread adapter 134 are described next. As shown to best advantage in FIG. 38, the essential components of the finished-stair-tread adapter 134 include a baluster mounting member 138, a riser plate 140, a tread plate 142, a plurality of slip nuts 174, and assorted screws and bolts. As shown in the upper portion of FIG. 38, the baluster mounting member 138 comprises a baluster support plate 146 having positioning slots 148 therethrough, a vertical back plate 150 having attachment holes 151 therethrough, and a leveling or positioning member 152. As shown to good advantage in FIGS. 38 and 40, the baluster support plate 146 may include a rear edge 154 that is joined to a lower edge 156 of the vertical back plate 150. Alternatively, the baluster support plate 146 and the vertical back plate 150 may be formed from a single piece of material that is bent at approximately 90° to form the baluster support plate 146 and vertical back plate 150. The leveling or positioning member 152 is then attached to a lower surface of the baluster support plate 146 adjacent to the rear edge 154 of the baluster support plate 146 as shown in FIG. 40.

Figure 41:
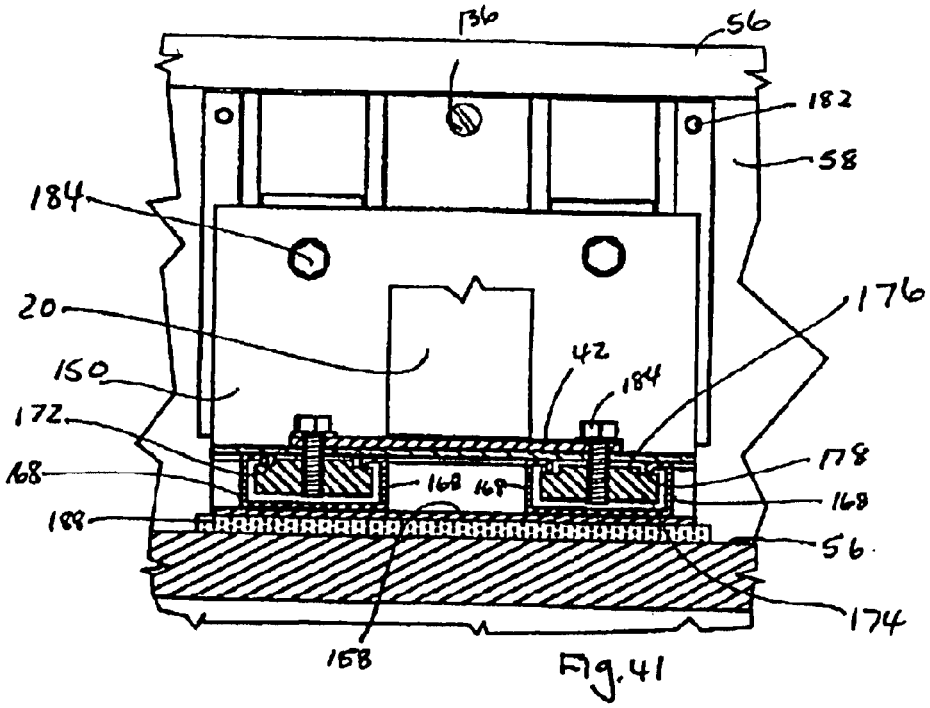
FIG. 41 is a fragmentary, cross-sectional view along line 41—41 of FIG. 40.

The tread plate 142 includes a horizontal mounting surface 158, a vertical leading edge surface 160, and an inwardly-turned ledge 162 extending from the lower edge of the leading edge surface 160. This inwardly-turned ledge 162, in combination with the leading edge surface 160 and a portion of the horizontal mounting surface 158 together form a leading edge clip, which holds the tread plate 142 in position over the leading edge 130 of a stair tread 56 (see, e.g., FIG. 40) whether that leading edge 130 is rounded (FIG. 40) or squared (FIG. 39). Two, elongated, C-shaped slip nut channels 164 are mounted (e.g., by welding) to the horizontal mounting surface 158 in spaced parallel configuration. Each of these slip nut channels 164 comprises a bottom wall 166, two side walls 168, two top walls 170, and two overhung free longitudinal edges 172. In the preferred embodiment, two slip nuts 174 are mounted in each of the horizontal slip nut channels 164. Each slip nut 174 has a threaded hole 175 through it. The cross section of each slip nut in a plane that is perpendicular to the axis of the threaded hole 175 is substantially square. As shown to best advantage in FIG. 41, which is a cross-sectional view taken along line 41—41 of FIG. 40 through two of the slip nuts 174, each slip nut includes a raised central portion 176 straddled on each side by an edge seat 178 that slippingly rides along one of the overhung free longitudinal edges 172 of a slip nut channel 164. As seen in FIG. 41, the raised central portion 176 is slightly narrower than the gap between the overhung free longitudinal edges 172 of the slip nut channels 164. This provides some play in the system to accommodate staircase irregularities.

The riser plate 140 comprises a vertical mounting surface 180 having a plurality of attachment holes 182 therethrough. In the preferred embodiment, two elongated, C-shaped slip nut channels 164' are affixed (e.g., by welding) to the vertical mounting surface 180 in spaced parallel configuration. A slip nut 174 is slippingly mounted in each of these vertical slip nut channels 164' mounted to the vertical mounting surface 180 of the riser plate 140. The slip nuts 174 mounted in the vertical slip nut channels 164' mounted to the vertical mounting surface 180 of the riser plate 140 are interchangeable with the slip nuts 174 mounted in the horizontal slip nut channels 164 mounted to the horizontal mounting surface 158 of the tread plate 142.

When a finished-stair-tread adapter 134 is mounted to a straight staircase, four baluster mounting bolt 184 and washer 186 combinations are passed through the attachment holes 72 in the base plate 42 of the baluster 20. These baluster mounting bolts 184 are then routed through one of the positioning slots 148 in the baluster support plate 146. Finally, the baluster mounting bolts 184 are threaded into one of the slip nuts 174 that are positioned in the horizontal slip nut channels 164. Similarly, additional mounting bolt 184 and washer 186 combinations are passed through attachment holes 151 in the vertical back plate 150 of the baluster mounting member 138 and threaded into corresponding slip nuts 174 mounted in the vertical slip nut channels 164' affixed to the vertical mounting surface 180 of the riser plate 140. A riser plate mounting screw 136 is then passed through one of the plurality of attachment holes 182 through the vertical mounting surface 180 of the riser plate 140 and threaded into a staircase riser 58. If the baluster 20 would interfere with placement of the riser plate attachment screw 136 through the vertical mounting surface 180 of the riser plate 140, the riser plate 140 may be attached to the riser 58 using the riser plate attachment screw 136 before the mounting bolts 184 that attach the baluster mounting member 138 to the riser plate 140 are threaded into position.

Figure 36:
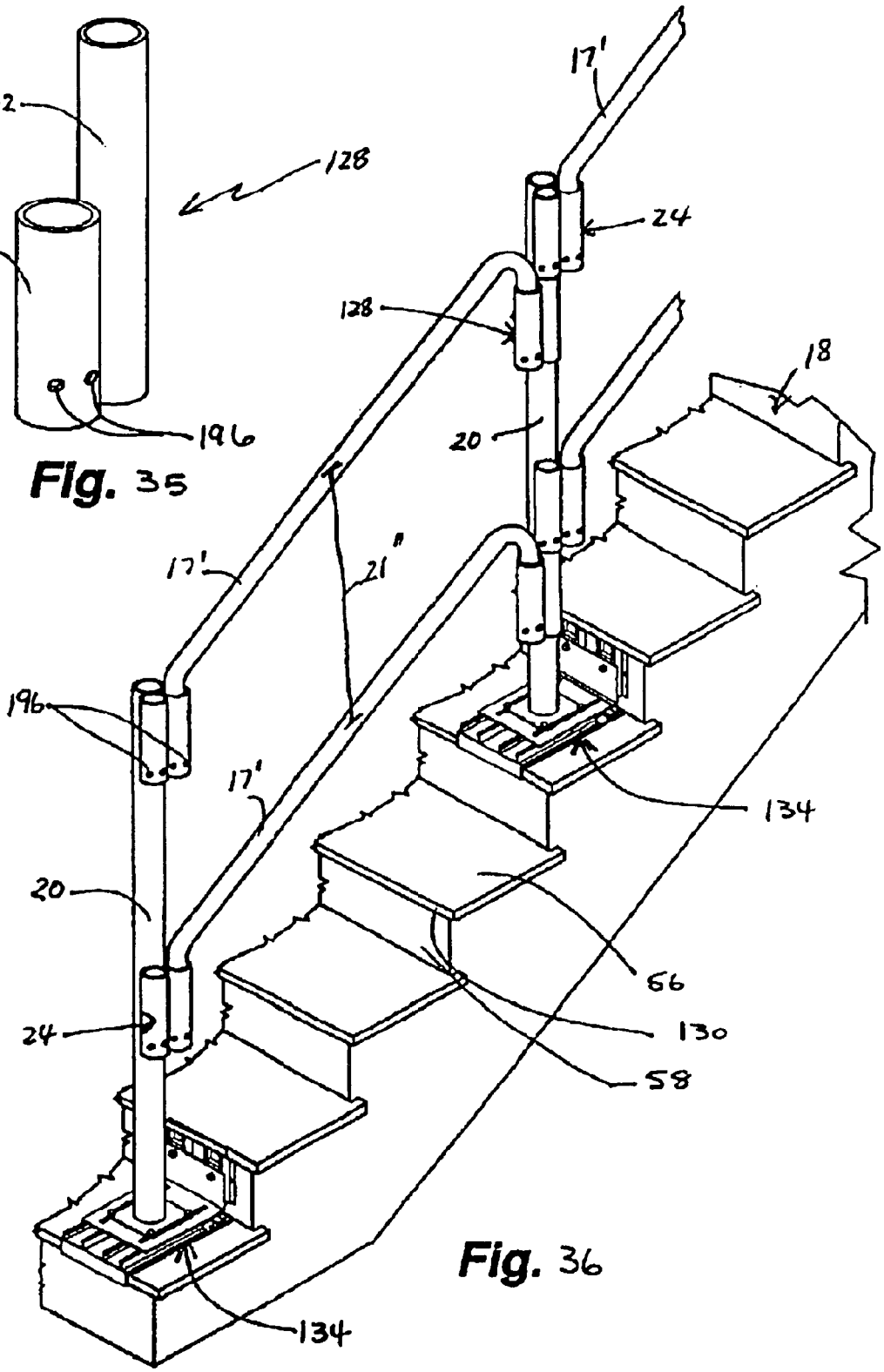
FIG. 36 is an isometric, fragmentary view depicting a section of rail mounted on a straight staircase using balusters mounted to finished-stair-tread adapters.
Figure 37:
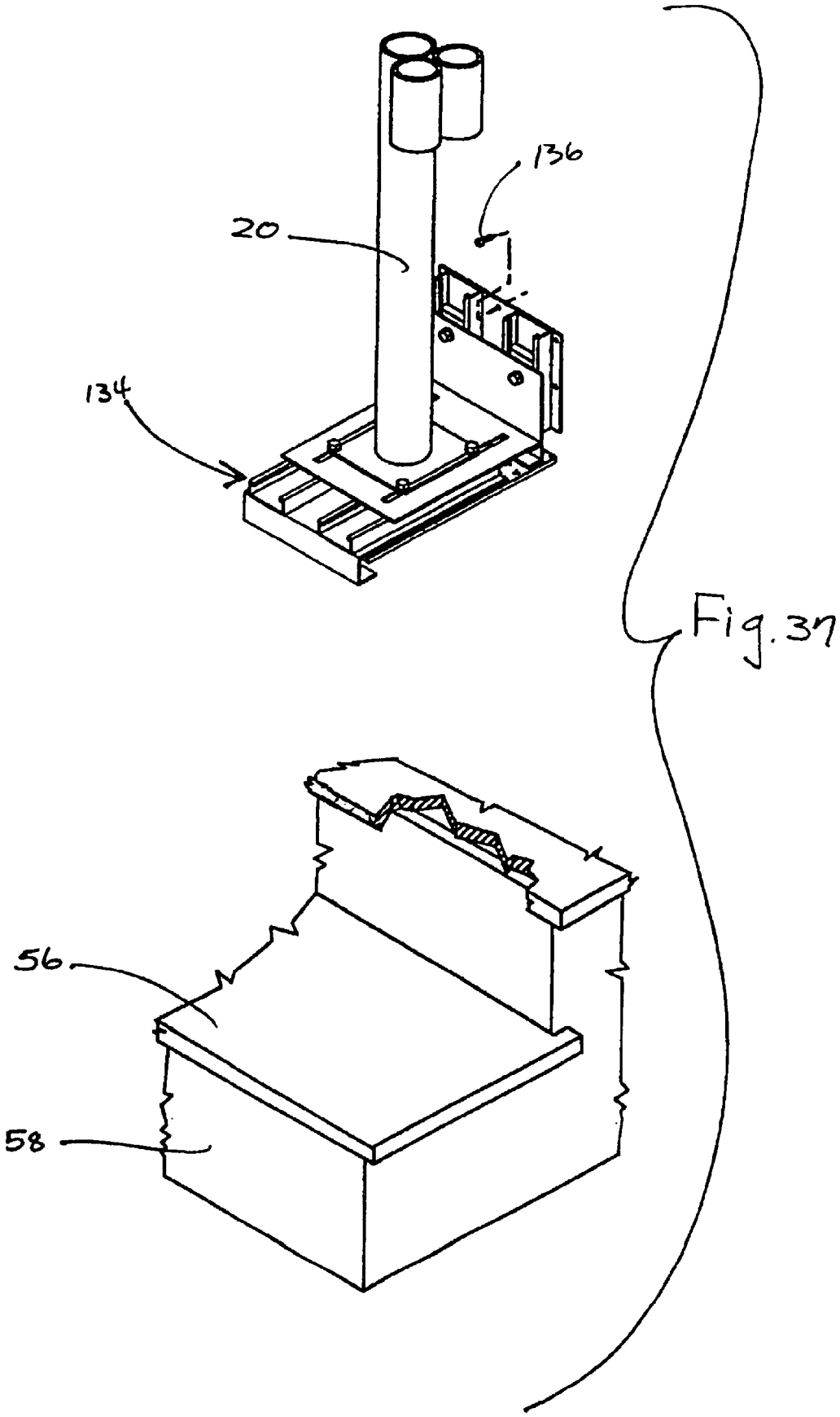
FIG. 37 is an enlarged and partially-exploded isometric view of a portion of a baluster mounted on a finished-stair-tread adapter shown in position above a portion of a staircase to which it will be attached.

To prevent damage to the finished stair treads 56, an anti-mar mat 188 is placed between the bottom of the horizontal mounting surface 158 of the tread plate 142 and the top of the finished stair tread 56. This anti-mar mat 188 can comprise any material that would protect the finished stair tread 56 (e.g., rubber, a piece of cardboard, a piece of carpet, or Masonite). The tread plate 142 is positioned on the stair tread 56 by hooking the tread clip at the leading edge of the tread plate 142 over the leading edge 130 of a stair tread 56 as shown in FIGS. 36, 39, and 40. Once the baluster unit 20 and finished tread adapter 134 are in position on a stair tread 56 as shown in FIG. 39, all of the mounting bolts 184 can be tightened to position the railing system on the staircase 18. When the mounting bolts 184 are tightened into their corresponding slip nuts 174, this drives the overhung free longitudinal edges 172 of the C-shaped channels 164, 164' firmly against the edge seats 178 straddling the threaded holes 175 through each slip nut 174, thereby firmly positioning the railing system on the staircase 18.

Figure 43:
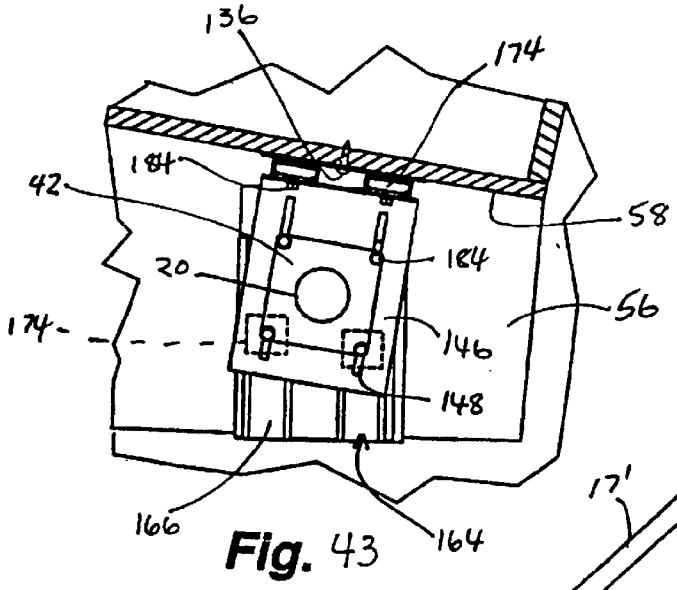
FIG. 43 is a fragmentary, cross-sectional view taken along line 43—43 of FIG. 42.
Figure 42:
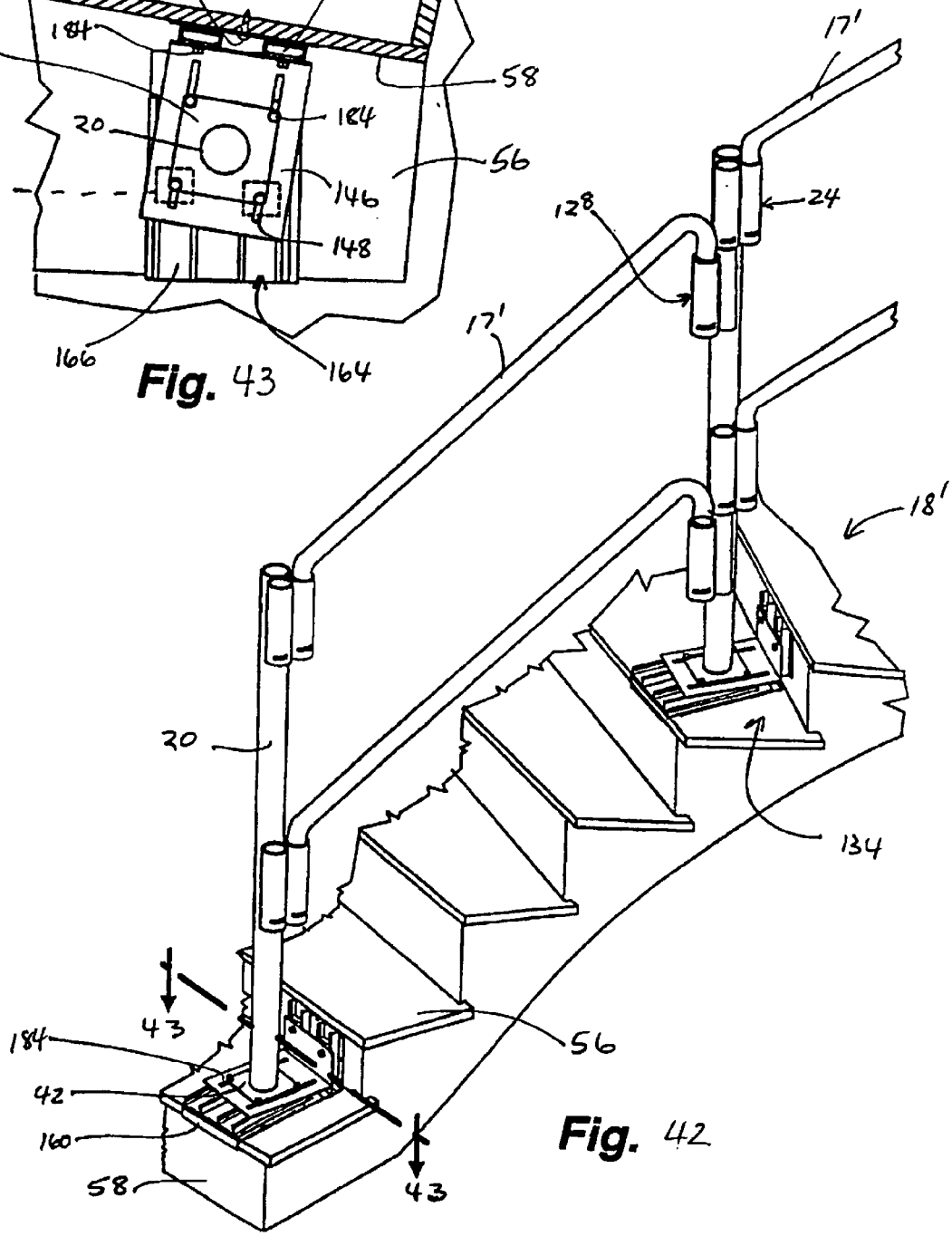
FIG. 42 is similar to FIG. 36, but depicts the railing system mounted on a curved staircase.

FIGS. 42 and 43 depict the railing of a curved staircase 18' using the finished-stair-tread adapter 134 discussed above. As shown to best advantage in FIG. 43, which is a fragmentary, cross-sectional view taken along line 43—43 of FIG. 42, depending upon the extent of curvature in the staircase 18', it may be necessary to use only two slip nuts 174 in the horizontal slip nut channels 164 comprising part of the tread plate 142.

FIGS. 44–52 depict a clamp-on railing system 190 for staircases having stringers 54 or for pan staircases. This system 190 is particularly useful on most temporary staircases, which typically are narrower than final staircases. Thus, as clearly shown in FIGS. 44 and 52, the clamp-on system 190 hooks on the outside of the staircase 18 rather than being affixed to the stair treads 56, which desirably saves tread width. In other words, since temporary staircases are typically narrow, contractors do not want to further narrow the useful path by putting the railing system on the stair treads 56. The clamp-on system 190 of the present invention maximizes the path width on staircases, particularly temporary staircases, while still providing protection.

Referring most particularly to FIGS. 44–49, various details of the clamp-on railing system 190 are described next. In the clamp-on railing system 190, a plurality of alternative staircase balusters or stanchions are bolted to a corresponding plurality of C-shaped mounting brackets 194. The stanchion 192 and mounting bracket 194 combinations are then attached to the staircase stringers 54 and connected by the desired number of staircase rails 17'. As shown in FIG. 44, you again need to use the stair rail adjusters 128 to ensure that the top rail is within the thirty-seven inch max OSHA requirement.

Figures 44, 45, 46:
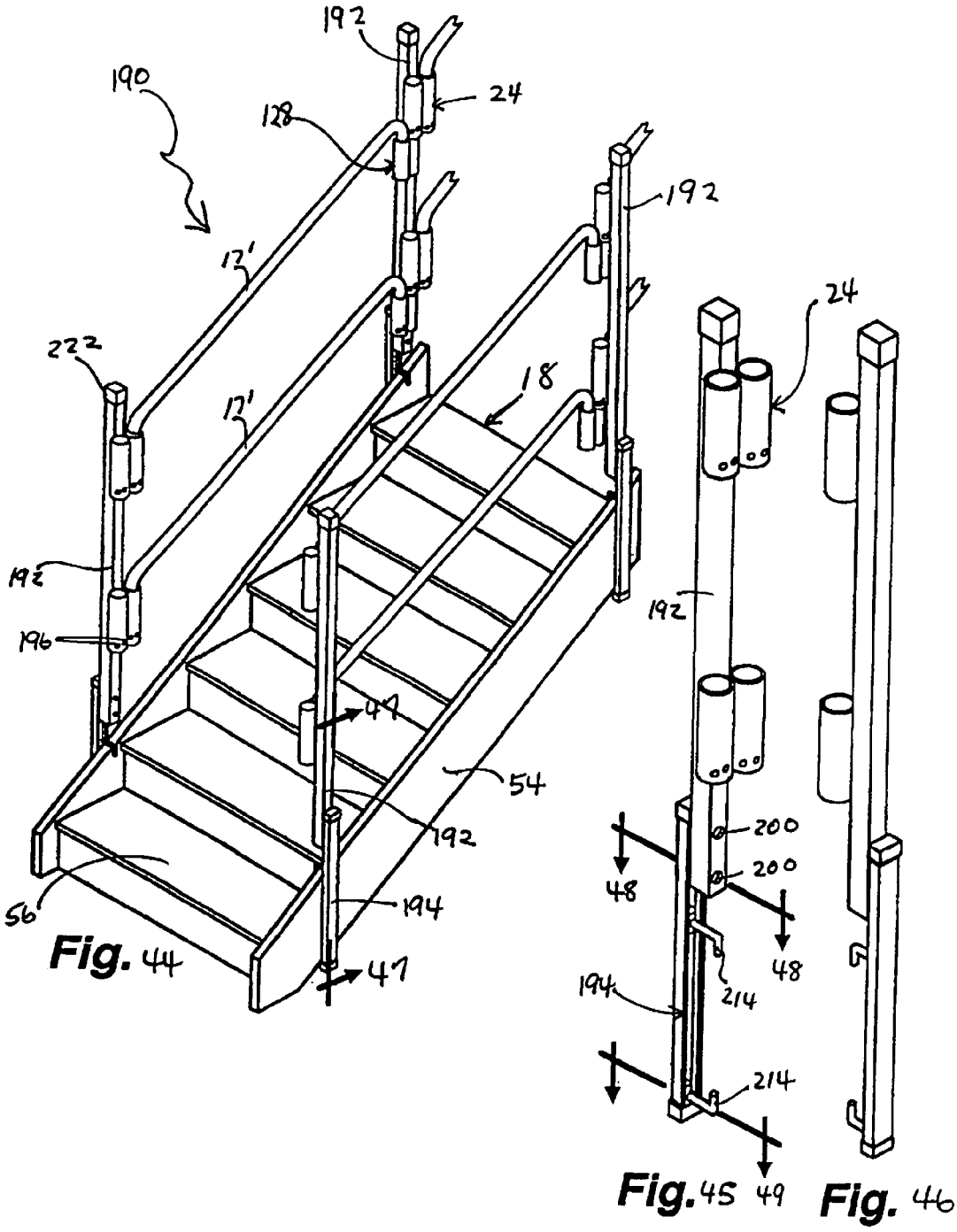
FIG. 44 depicts a clamp-on staircase railing system for use on pan staircases or staircases having stringers.
FIG. 45 is an enlarged, isometric view of one baluster or stanchion and its mounting bracket as used in the clamp-on staircase railing system depicted in FIG. 44.
FIG. 46 is an enlarged, isometric view similar to FIG. 45, but depicting the stanchion and its mounting bracket from a different direction.

FIGS. 44 and 45 also show a most preferred means to facilitate temporary attachment of rails 17, 17' to balusters or stanchions (see also FIGS. 35 and 36). In particular, rather than using rivet slots 66 in each rail support (e.g., FIGS. 4 and 7), two round punch holes 196 are used. The two round holes 196 are less costly to punch than are the rivet slots 66. Once a rail 17, 17' is properly positioned in a support, a fastener is placed in a punch hole 196 to attach the connector portion 21 of the rail to the support. A preferred fastener is a self-tapping #10 screw having a #12 head, which may be inserted into a punch hole 196 and screwed into the connector portion 21 of the rail without first drilling a new hole in the rail's connector portion. Other fasteners (e.g., a rivet 68 (FIG. 4), a regular screw, or a bolt) could be used. Alternatively, once a rail 17, 17' is properly positioned in a rail support 47, a hole may be drilled into the connector portion 21 of the rail 17, 17' using a punch hole 196 as a guide. A fastener may then be inserted through the punch hole 196 and the just-drilled hole through the connector portion 21 to temporarily connect the rail 17, 17' to the support 47. Also, if a retention hole 64 (FIG. 4) already exists in the connector portion of the rail, and if that retention hole lines up with a punch hole 196, a fastener could use that existing retention hole to temporarily connect the rail to the support.

Figure 47:
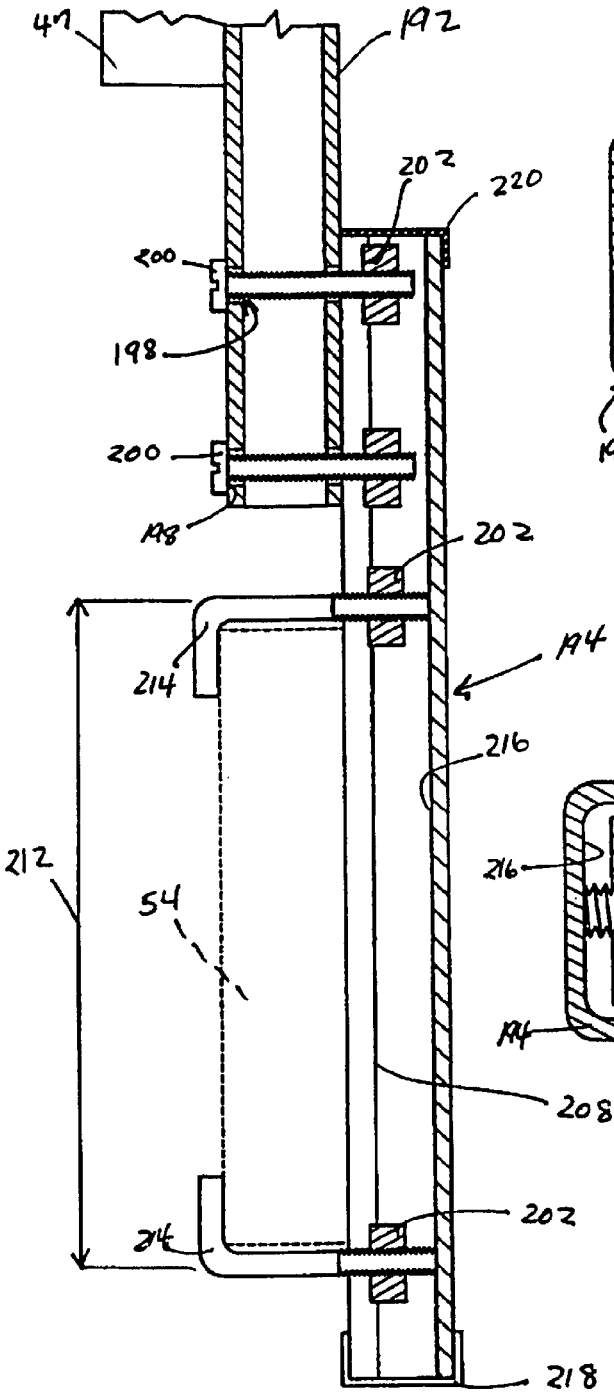
FIG. 47 is an enlarged, fragmentary cross-sectional view taken along line 47—47 of FIG. 44.

FIG. 47 is an enlarged, fragmentary cross-sectional view taken along line 47—47 of FIG. 44. A fragmentary portion of a rail support 47 is shown in the upper left portion of FIG. 47 attached to a fragmentary portion of a stanchion 192. Two mounting holes 198 are drilled through the lower end of the stanchion 192. Each attachment bolt 200 is subsequently threaded into a large slip nut 202 that is slippingly mounted in the C-shaped mounting bracket 194.

Figure 48:
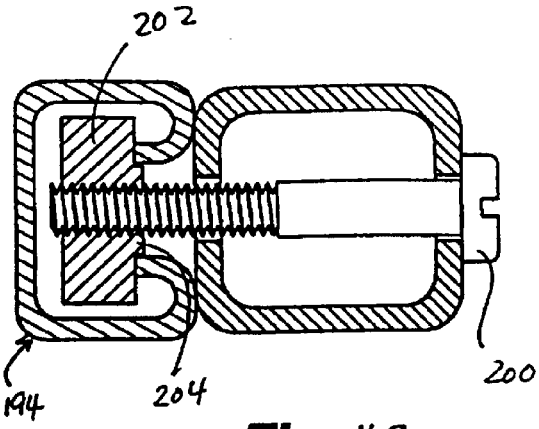
FIG. 48 is a cross-sectional view taken along line 48—48 of FIG. 45.
Figure 49:
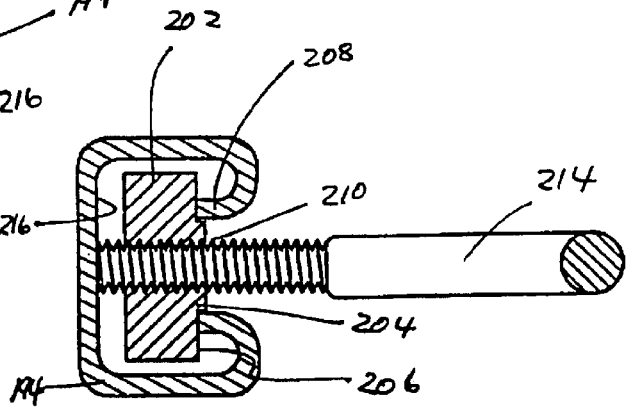
FIG. 49 is a cross-sectional view taken along line 49—49 of FIG. 45.

FIG. 48 is an enlarged cross-sectional view taken along line 48—48 of FIG. 45, and FIG. 49 is an enlarged cross-sectional view taken along line 49—49 of FIG. 45. As clearly shown in each of FIGS. 48 and 49, the large slip nuts 202 are similar to the slip nuts 174 described above in connection with FIGS. 38 and 41. Each large slip nut 202 again includes a raised central portion 204 straddled by two edge seats 206. The edge seats 206 slippingly accommodate inwardly-turned longitudinal edges 208 of the C-shaped mounting bracket 194. The raised central portion 204 is approximately the same width as the gap between these inwardly-turned longitudinal edges 208. Thus, the raised central portion 204 essentially fills the gap between the inwardly-turned longitudinal edges 208. The large slip nuts 202 again include a threaded hole 210 through their centers.

As clearly shown in FIGS. 45, 47, and 48, the attachment bolts 200 are each threaded into a large slip nut 202 to rigidly connect a stanchion 192 to its C-shaped mounting bracket 194. As clearly shown in FIGS. 45, 47, and 49, "L" bolts 214 are threaded into corresponding large slip nuts 202 and arranged to point inwardly towards each other. The vertical distance 212 (FIG. 47) between the "L" bolts 214 is adjustable by loosening the "L" bolts 214 in their slip nuts 202, and moving the slip nuts 202 to a desired position along the C-shaped mounting bracket 194 and then tightening the "L" bolt 214. Thus, the clamp-on system 190 easily accommodates stringers 54 having different widths. In the depicted embodiment, the "L" bolts 214 must bottom out and be tightened firmly against an inner surface 216 of the C-shaped mounting bracket 194. Thus, the "L" bolts 214 are selected based upon the thickness of the stringer 54 or other member to which the stanchion 192 and C-shaped mounting bracket 194 combination are being attached. Lower end caps 218, intermediate end caps 220, and upper end caps 222 are provided to give a finished look while helping to keep dust and other contaminants from getting into the stanchions 192 and mounting brackets 194.

Figure 50:
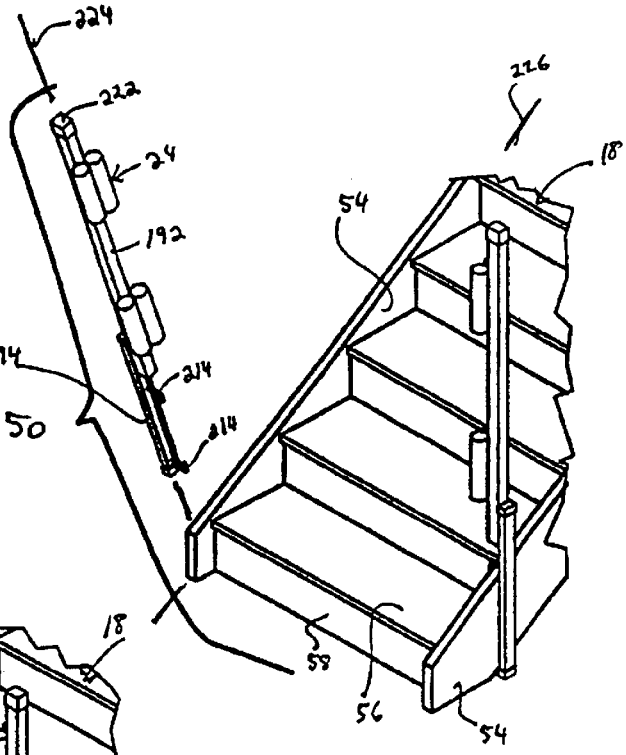
FIGS. 50–52 depict the process of attaching the baluster and mounting bracket combination shown in FIGS. 44–49 to a staircase.
Figure 51:
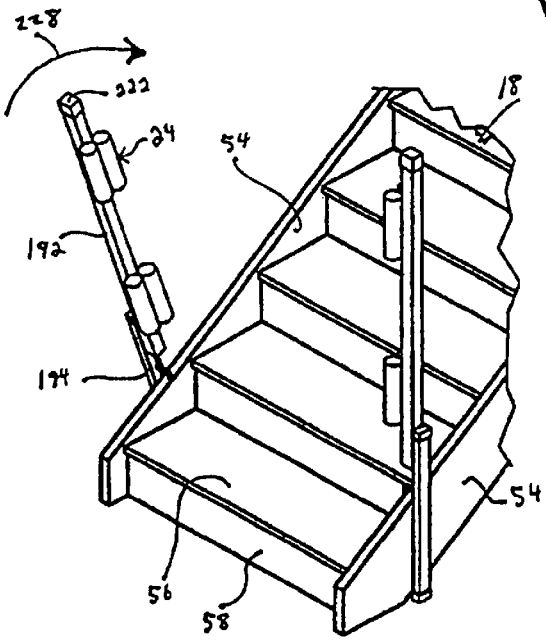
Figure 52:
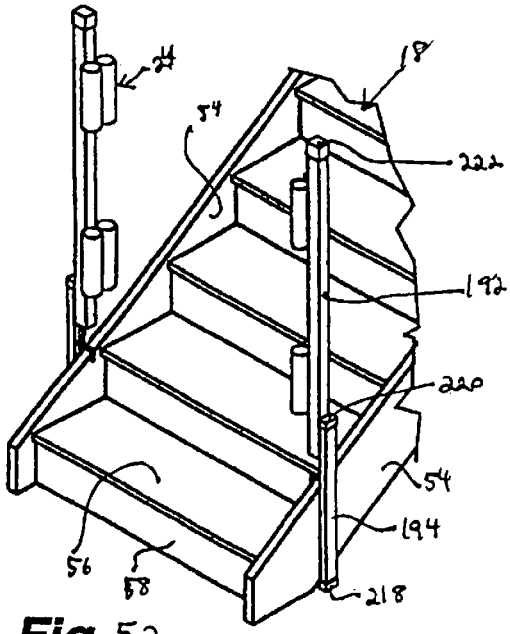

FIGS. 50–52 depict the steps followed to attach a stanchion 192 and its mounting bracket 194 to a stringer 54 or pan staircase. As shown in FIG. 50, the stanchion 192 and mounting bracket 194 combination is angled relative to the staircase to permit the stringer 54 to pass between the upper and lower "L" bolts 214. Generally this means that the longitudinal axis 224 of the stanchion 192 and mounting bracket 194 combination is arranged to be perpendicular to the longitudinal axis 226 of the stringer 54. Once in position over the stringer 54 as shown in FIG. 50, the stanchion 192 and mounting bracket 194 combination is rotated in the direction of arrow 228 in FIG. 51 and into the final position shown in FIG. 52. After two adjacent stanchions 192 are in the position along one side of a staircase, rails 17' may be placed between the stanchion 192 and mounting bracket 194 combinations as shown in FIG. 44.

Although various embodiments of this invention have been described above, those skilled in the art could make numerous alterations to the disclosed embodiments without departing from the spirit or scope of this invention. For example, although many of the drawings show the rails 17, 17' as being of substantially the same length no matter where used, it is an important aspect of the present invention that the rails 17, 17' may be made to any length to accommodate particular construction sites. For example, the user could be supplied with numerous different rail lengths from which they could choose during a particular installation of the modular railing system 10. Current OSHA regulations permit use of horizontal rails up to eight feet long. In the most preferred embodiment, however, it is desirable to produce rails 17 that vary from six inches long to six feet and six inches long in six inch increments. It is also desirable to produce staircase rails 17' of sufficient length to extend at an angle along a section of staircase comprising up to eighty inches of horizontal stair treads 56 (i.e., staircase rails that can be used to rail eighty inch runs of stairs). Also, the diameter of the rails 17, 17' and tie pipes 32, when made from round stock, may vary depending on the type of material used and the strength or support required. The most preferred embodiment of the present invention uses 1¼ inch diameter round steel stock for the rails 17, 17' and the tie pipes 32. It is possible, however, to make the rails 17, 17', tie pipes 32, and balusters 20 from stock having a noncircular cross-section. The distance between vertically adjacent rails 17, 17' or tie pipes 32 can also vary widely without deviating from the spirit or scope of the present invention, but in the preferred embodiment, the rails 17, 17' in sections like those depicted in FIGS. 2, 3, 7, 17, 36, 42, and 44 are approximately twenty-one inches apart.

Thus, in the three-rail system depicted in, for example, FIGS. 2 and 7, the center of the top rail is approximately sixty-three inches above the surface to which the balusters units 46 are attached. Preferably, the balusters 20, 21 are constructed from 1¾ inch diameter, 16 gauge (U.S. standard) steel stock. By way of example, the balusters for a two-rail system (see FIG. 16) are forty inches long, and the balusters for a three-rail system (see FIG. 12) are sixty inches long. The supports 47 are preferably made from six inch lengths of 12 inch diameter, 13 gauge (U.S. standard) steel stock. All directional references (e.g., upper, lower, upward, downward, left, right, leftward, rightward, top, bottom, above, below, vertical, horizontal) are only used for identification purposes to aid the reader's understanding of the present invention, and do not create limitations, particularly as to the position, orientation or use of the disclosed invention. It is intended that all matter contained in the above description or shown in the accompanying drawings will be interpreted as illustrative only and not limiting.

I claim:

1. A modular railing system for railing a staircase, said modular railing system comprising:

a plurality of staircase rails;

a plurality of balusters for supporting said plurality of staircase rails; and a finished-stair-tread adapter to attach one baluster of said plurality of balusters to the staircase, said finished-stair-tread adapter comprising:

a baluster mounting member to mount said one baluster;

a tread plate for attaching said baluster mounting member to a tread of the staircase, said tread plate having a first plurality of slip nuts slidingly mounted therein, wherein a fastener hole extends through each slip nut of said first plurality of slip nuts; and a riser plate for attaching said baluster mounting member to a riser of the staircase, said riser plate having a second plurality of slip nuts slidingly mounted therein, wherein a fastener hole extends through each slip nut of said second plurality of slip nuts.

2. The modular railing system of claim 1, said baluster mounting member further comprising:

a baluster support plate having positioning slots therethrough that are each adapted to receive a fastener;

a vertical back plate having attachment holes therethrough that are each adapted to receive a fastener; and a leveling member adapted to level said baluster support plate.

3. The modular railing system of claim 2, said tread plate further comprising:

a horizontal mounting surface adapted to support said baluster support plate;

a vertical leading edge surface having a lower edge and adapted to engage the tread of the staircase;

an inwardly-turned ledge extending from said lower edge of said leading edge surface and adapted to extend under the tread of the staircase; and at least one horizontal slip nut channel mounted to said horizontal mounting surface, wherein said first plurality of slip nuts are slidingly mounted in said at least one horizontal slip nut channel.

4. The modular railing system of claim 3, said riser plate further comprising:

a vertical mounting surface having a plurality of attachment holes therethrough and adapted to support said vertical back plate of said baluster mounting member; and at least one vertical slip nut channel mounted to said vertical mounting surface, wherein said second plurality of slip nuts are slidingly mounted in said at least one vertical slip nut channel.

5. The modular railing system of claim 4, wherein each of said vertical and horizontal slip nut channels comprises a bottom wall, two side walls, two top walls, and two overhung free longitudinal edges, wherein each of said slip nuts in said first plurality of slip nuts is interchangeable with each of the slip nuts in said second plurality of slip nuts, and further wherein each of said slip nuts includes a raised central portion straddled on each side by an edge seat that slippingly rides along one of said overhung free longitudinal edges of one of said slip nut channels.

6. The modular railing system of claim 5, wherein each baluster of said plurality of balusters has a base plate with attachment holes through it, wherein fasteners are passed through said attachment holes in said base plate and through one of said positioning slots in said baluster support plate, and are fastened into one of said slip nuts comprising said first plurality of slip nuts, wherein additional fasteners are passed through said attachment holes through said vertical back plate of said baluster mounting member and fastened into one of said slip nuts comprising said second plurality of slip nuts, and wherein a riser plate mounting screw is passed through one of said plurality of attachment holes through said vertical mounting surface of said riser plate and is adapted to be threaded into a staircase riser.

7. A finished-stair-tread adapter comprising:

a baluster mounting member adapted to mount a baluster for supporting a rail of a staircase railing system, said baluster mounting member comprising:

a baluster support plate adapted to support the baluster and having positioning slots therethrough wherein each of said positioning slots is adapted to receive a fastener;

a vertical back plate connected to said baluster support plate and having attachment holes therethrough, wherein each of said attachment holes is adapted to receive a fastener; and a leveling member adapted to level said baluster support plate;

a tread plate adapted to attach said baluster mounting member to a tread of a staircase, said tread plate having a first plurality of slip nuts slidingly mounted therein, wherein a fastener hole extends through each slip nut of said first plurality of slip nuts; and a riser plate adapted to attach said baluster mounting member to a riser of the staircase, said riser plate having a second plurality of slip nuts slidingly mounted therein, wherein a fastener hole extends through each slip nut of said second plurality of slip nuts.

8. The finished-stair-tread adapter of claim 7, said tread plate further comprising a horizontal mounting surface adapted to support said baluster support plate of said baluster mounting member;

a vertical leading edge surface having a lower edge and adapted to engage the tread of the staircase;

an inwardly-turned ledge extending from said lower edge of said leading edge surface and adapted to extend under the tread of the staircase; and at least one horizontal slip nut channel mounted to said horizontal mounting surface, wherein said first plurality of slip nuts are slidingly mounted in said at least one horizontal slip nut channel.

9. The finished-stair-tread adapter of claim 8, said riser plate further comprising a vertical mounting surface having a plurality of attachment holes therethrough and adapted to support said vertical back plate of said baluster mounting member; and at least one vertical slip nut channel mounted to said vertical mounting surface, wherein said second plurality of slip nuts are slidingly mounted in said at least one vertical slip nut channel.

10. The finished-stair-tread adapter of claim 9, wherein each of said vertical and horizontal slip nut channels comprises a bottom wall, two side walls, two top walls, and two overhung free longitudinal edges, wherein each of said slip nuts in said first plurality of slip nuts is interchangeable with each of the slip nuts in said second plurality of slip nuts, and further wherein each of said slip nuts includes a raised central portion straddled on each side by an edge seat that slippingly rides along one of said overhung free longitudinal edges of one of said slip nut channels.

11. The finished-stair-tread adapter of claim 10, wherein fasteners are passed through said attachment holes through said vertical back plate of said baluster mounting member and fastened into one of said slip nuts comprising said second plurality of slip nuts, and wherein a riser plate mounting screw is passed through one of said plurality of attachment holes through said vertical mounting surface of said riser plate and is adapted to be threaded into the staircase riser.

12. The finished-stair-tread adapter of claim 8, said finished-stair-tread adapter further comprising an anti-mar mat adapted for placement between said horizontal mounting surface of said tread plate and the tread of the staircase.

13. The finished-stair-tread adapter of claim 7, wherein said baluster support plate further comprises a rear edge, and wherein said vertical back plate further comprises a lower edge, and wherein said rear edge of said bluster support plate is affixed to said lower edge of said vertical back plate.

14. The finished-stair-tread adapter of claim 13, wherein said leveling member is affixed to a lower surface of said baluster support plate adjacent to said rear edge of said baluster support plate.

15. A finished-stair-tread adapter comprising:

a baluster mounting member adapted to mount a baluster for supporting a rail of a staircase railing system, said baluster mounting member comprising:

a baluster support plate adapted to support the baluster and having positioning slots therethrough, wherein said baluster support plate further comprises a rear edge;

a vertical back plate having attachment holes therethrough, wherein said vertical back plate and said baluster support plate are formed from a single piece of material that is bent at approximately 90° to form said rear edge of said baluster support plate, thereby creating said baluster support plate and said vertical back plate from said single piece of material; and a leveling member adapted to level said baluster support plate;

a tread plate adapted to attach said baluster mounting member to a tread of a staircase, said tread plate having a first plurality of slip nuts slidingly mounted therein, wherein a fastener hole extends through each slip nut of said first plurality of slip nuts; and a riser plate adapted to attach said baluster mounting member to a riser of the staircase, said riser plate having a second plurality of slip nuts slidingly mounted therein, wherein a fastener hole extends through each slip nut of said second plurality of slip nuts.

16. The finished-stair-tread adapter of claim 15, wherein said leveling member is affixed to a lower surface of said baluster support plate adjacent to said rear edge of said baluster support plate.

* * * * *